US010611564B1

(12) United States Patent
Stravitz

(10) Patent No.: US 10,611,564 B1
(45) Date of Patent: Apr. 7, 2020

(54) HEIGHT ADJUSTABLE WASTE DISPOSAL DEVICE WITH BAG-GRABBING MEMBRANE

(71) Applicant: Dooli Products, Inc., New York, NY (US)

(72) Inventor: David M Stravitz, New York, NY (US)

(73) Assignee: Dooli Products, LLC, New York, NY (US)

( * ) Notice: Subject to any disclaimer, the term of this patent is extended or adjusted under 35 U.S.C. 154(b) by 0 days.

(21) Appl. No.: 16/238,133

(22) Filed: Jan. 2, 2019

(51) Int. Cl.
*B65F 1/00* (2006.01)
*B65F 1/16* (2006.01)
*B65F 1/06* (2006.01)

(52) U.S. Cl.
CPC ..... *B65F 1/0046* (2013.01); *B65F 1/0073* (2013.01); *B65F 1/06* (2013.01); *B65F 1/16* (2013.01); *B65F 2001/0086* (2013.01)

(58) Field of Classification Search
CPC ..... B65F 1/0046; B65F 1/0073; B65F 1/06; B65F 1/16; B65F 2001/0086
USPC ..... 220/532
See application file for complete search history.

(56) References Cited

U.S. PATENT DOCUMENTS 1,978,314 A 10/1934 Lancaster
2,426,911 A 9/1947 Williamson
4,483,095 A 11/1984 Webringer
4,644,610 A 2/1987 Fish
5,016,753 A 5/1991 Henderson
D332,203 S 1/1993 Fernandez-Guthrie
5,205,530 A 4/1993 Fish
5,226,551 A 7/1993 Robbins, III
5,439,128 A * 8/1995 Fishman ..... A45F 3/20 206/218
5,573,129 A 11/1996 Nagata et al.
5,575,398 A 11/1996 Robbins, III
5,695,088 A 12/1997 Kasbohm
5,904,820 A 6/1999 Yeh
5,987,708 A 11/1999 Newton
6,364,146 B1 4/2002 Beckerer, Jr.
(Continued)

FOREIGN PATENT DOCUMENTS

EP 2801289 A1 11/2014

OTHER PUBLICATIONS

Office action dated Jun. 24, 2019 for U.S. Appl. No. 16/207,338.
(Continued)

*Primary Examiner* — Ernesto A Grano
(74) *Attorney, Agent, or Firm* — Brian Roffe

(57) ABSTRACT

Waste container including a telescoping wall construction defining an interior space receivable of a bag and which has wall sections positionable in a plurality of different positions to provide the wall construction with different operational heights, and a bag handling assembly coupled to the wall construction. The wall sections can be locked into engagement with one another and released when desired. The bag handling assembly includes a bag support defining an opening and including a membrane having at least one slot. Each slot is defined by a pair of opposed walls, possibly parallel to one another. The opposed walls of each slot are spaced apart a distance to enable a bag, when inserted through the slot(s), to be pinched by the opposed walls.

20 Claims, 20 Drawing Sheets

(56) References Cited

U.S. PATENT DOCUMENTS 6,484,897 B1 11/2002 Crawley
6,612,099 B2 9/2003 Stravitz
6,666,329 B1 12/2003 Charbonneau
6,804,930 B2 10/2004 Stravitz
6,851,251 B2 2/2005 Stravitz
7,114,314 B2 10/2006 Stravitz
7,146,785 B2 12/2006 Stravitz
7,243,811 B1 7/2007 Ramsey
7,316,100 B2 1/2008 Stravitz et al.
7,434,377 B2 10/2008 Stravitz et al.
7,494,022 B2 2/2009 Buchalter et al.
7,503,152 B2 3/2009 Stravitz et al.
7,503,159 B2 3/2009 Stravitz et al.
7,617,659 B2 11/2009 Stravitz et al.
7,694,838 B2 4/2010 Yang et al.
7,708,188 B2 5/2010 Stravitz et al.
7,712,285 B2 5/2010 Stravitz et al.
7,641,835 B2 11/2010 Ramsey et al.
7,963,414 B1 6/2011 Stravitz
8,061,546 B2 11/2011 Ramsey
8,127,519 B2 3/2012 Stravitz
8,215,089 B2 * 7/2012 Stravitz ..... B65B 67/1277 53/370
8,235,237 B1 8/2012 Stravitz
8,266,871 B1 9/2012 Stravitz
8,393,489 B1 3/2013 Stravitz
8,844,751 B2 * 9/2014 Sakaguchi ..... B65F 1/06 220/253
8,910,821 B1 12/2014 Stravitz
8,973,774 B1 3/2015 Stravitz
9,828,721 B2 11/2017 Silverman et al.
9,950,853 B2 4/2018 Irwin-Kieling et al.
10,053,283 B1 8/2018 Stravitz
10,081,481 B2 9/2018 Fernandez de Castro
10,099,855 B1 10/2018 Higgins, II
10,273,070 B2 4/2019 Perkins et al.
2003/0085227 A1 5/2003 Azzarello
2005/0056649 A1 3/2005 Simonson et al.
2005/0127074 A1 * 6/2005 Kusuma ..... B65D 21/086 220/6
2007/0289772 A1 12/2007 Kuroda et al.
2008/0000912 A1 1/2008 Lin
2008/0264948 A1 10/2008 Kovacevich et al.
2009/0046955 A1 2/2009 Schember et al.
2009/0230135 A1 9/2009 Ghitza
2010/0005762 A1 1/2010 Stravitz
2010/0140423 A1 6/2010 Davies et al.
2010/0176126 A1 7/2010 Shikano
2011/0100996 A1 5/2011 Dunn et al.
2011/0170807 A1 7/2011 Khubani
2011/0272419 A1 * 11/2011 Vanderberg ..... B65D 21/086 220/666
2012/0211494 A1 8/2012 Morand
2013/0075406 A1 3/2013 Sakaguchi et al.
2013/0181000 A1 * 7/2013 Miksovsky ..... A45F 3/20 220/780
2013/0277364 A1 * 10/2013 Kusuma ..... A45F 3/20 220/8
2014/0042168 A1 2/2014 Dunn et al.
2015/0041478 A1 * 2/2015 Abrams ..... A47J 41/0022 220/592.17
2015/0217900 A1 8/2015 Poulin
2015/0251795 A1 * 9/2015 Tsui ..... A45C 7/0031 215/306
2015/0251808 A1 * 9/2015 Tsui ..... A45F 3/20 220/8
2015/0251809 A1 * 9/2015 Jasin ..... F41H 3/00 220/8
2015/0253055 A1 * 9/2015 Tsui ..... B65D 21/086 62/62
2015/0291309 A1 10/2015 McGregor
2016/0059990 A1 * 3/2016 Patikas-Bryant .... B65D 21/086 220/523
2016/0167872 A1 6/2016 Dunn et al.
2016/0347503 A1 * 12/2016 Tsui ..... B65D 1/0292
2018/0065778 A1 * 3/2018 Johnson ..... B65D 21/086
2019/0075973 A1 * 3/2019 Charleson ..... A47J 43/27
2019/0085503 A1 * 3/2019 Tsui ..... D06F 95/002
2019/0119000 A1 * 4/2019 Tsui ..... B65D 43/02

OTHER PUBLICATIONS

Parameter folding trash can, downloaded on Dec. 14, 2018.
Search report for International Application PCT/US2019/019385 dated Apr. 26, 2019.
Written opinion for International Application PCT/US2019/019385 dated Apr. 26, 2019.

* cited by examiner

FIG. 13
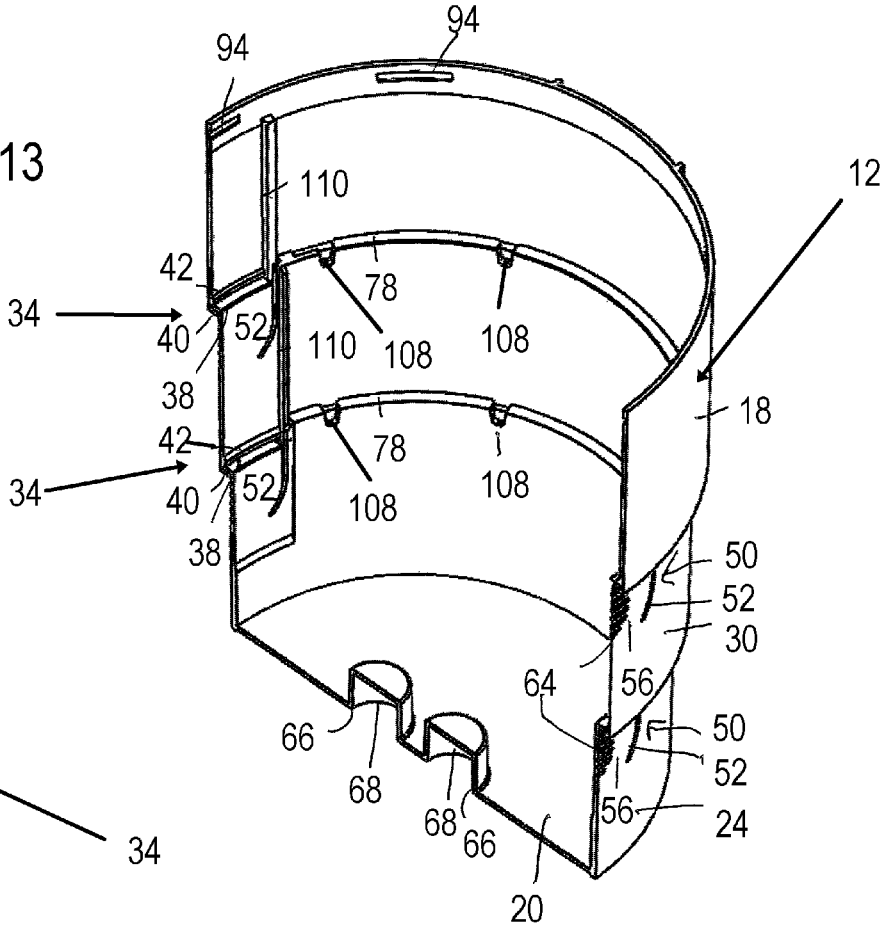
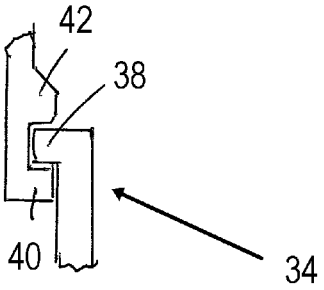
FIG. 14

HEIGHT ADJUSTABLE WASTE DISPOSAL DEVICE WITH BAG-GRABBING MEMBRANE

FIELD OF THE INVENTION

The present invention relates generally to height-adjustable waste disposal devices having a membrane that controls access to a bag and also to an attachment for a waste disposal device including a membrane that engages the bag to reduce odor leakage from waste contents in the bag below the membrane.

BACKGROUND OF THE INVENTION

Small waste disposal devices are common in households with toddlers in diapers, households with pets, hospitals, doctors' offices, biohazard laboratories, assisted living facilities, nursing homes and other locations where waste is generated and must be disposed of in a sanitary manner. Further, if the waste emits odors, the waste disposal device should also contain odors emanating from the waste.

Numerous waste disposal devices exist including those disclosed in U.S. Pat. Nos. 6,612,099, 6,804,930, 6,851,251, 7,114,314, 7,146,785, 7,316,100, 7,434,377, 7,503,152, 7,503,159, 7,617,659, 7,708,188, 7,712,285, 7,963,414, 8,127,519, 8,215,089, 8,235,237 and 8,266,871, all of which are incorporated by reference herein. Additionally, innovative waste disposal devices are disclosed in U.S. patent application Ser. No. 12/172,715 filed Jul. 14, 2008 (US 20100005762), Ser. No. 13/172,976 filed Jun. 30, 2011, and Ser. No. 13/270,697 filed Oct. 11, 2011, all of which are also incorporated by reference herein.

Some of these waste disposal devices include a lid which is coupled to a rotation mechanism whereby upon closure of the lid, the rotation mechanism converts the closing movement of the lid into rotation of a twisting mechanism which engages with a length of tubing or a plastic bag in the waste disposal device to thereby cause formation of a twist in the tubing or bag. The twist is situated above the waste products in the tubing or bag so that emanation of odors from the waste products in the container is reduced.

As an example, U.S. Pat. No. 8,393,489 (Stravitz) describes a container defining a waste-receiving compartment having an opening, a lid connected to the container and having a first, closed position covering the opening of the container and a second, open position in which the opening is exposed, and a rotation mechanism arranged in the container to rotate the waste-containing member when present in the container. The rotation mechanism rotates the waste-containing member upon closure of the lid without manual handling of the lid. To this end, the rotation mechanism includes a rack gear coupled to the lid at an upper end region thereof and a gear assembly having a first gear in meshing engagement with the rack gear, and a second, drive gear in meshing engagement with the waste-containing member and which is rotationally coupled to the first gear. Downward movement of the rack causes rotation of the waste-containing member by means of the gear assembly. A foot pedal assembly causes both opening of the lid when depressed and closure of the lid when the pressing force is removed. The foot pedal assembly includes a foot pedal which extends outward from a lower region of the container, a horizontal actuating member connected to the foot pedal at a first end region, and a spring that is moved against its bias upon depression of the foot pedal and returns to its original state when the pressing force on the foot pedal is removed.

The spring is coupled to the rack gear such that when the spring returns to its original state, the spring pulls the rack gear downward and thereby enables or causes closure of the lid and rotation of the waste-containing member.

Another important patent in this field is U.S. Pat. No. 10,053,283 (Stravitz) which describes a container including a bag handling assembly having a retainer coupled to a container wall, a bag support pivotally coupled to the retainer, and a closure component pivotally coupled to the bag support independent of the pivotal coupling of the bag support to the retainer. A first attachment structure pivotally attaches the bag support to the retainer, e.g., a hinge component on the retainer and a cooperating hinge component on the bag support on a first side of an opening defined by the retainer. A second attachment structure pivotally attaches the closure component to the bag support, e.g., an additional hinge component on the bag support and a cooperating hinge component on the closure component on a second side of the opening defined by the retainer. To fix the bag between the closure component and the bag support, the bag support includes an inner wall for supporting an open end of the bag, as well as an outer wall spaced from the inner wall, and a rim portion between the inner and outer walls, with a channel being defined above the rim portion between the inner and outer walls. The closure component defines a channel on an underside dimensioned relative to the inner wall such that when the closure component is pivoted against the bag support, the inner wall is received in the channel. To secure the closure component to the bag support, the closure component preferably includes a tab and the bag support preferably includes a flexible retainer that cooperates with the tab to enable temporary securing of the closure component to the bag support via engagement of the tab with the retainer. The bag support optionally includes a membrane having intersecting channels and intersecting slits at an angle from the channels, the channels being dimensioned to allow the bag to be received therein.

It is recognized that some of the previously issued U.S. patents to the inventor describe waste containers that utilize a bag and wherein, upon opening and or closing of a lid, a series of gears rotates a pliable membrane having fingers through which the bag extends to cause temporary twisting and or un-twisting of a temporary twist in the upper region of the bag above the waste. One purpose of the temporary twist is to substantially contain (hold down) offensive odor until such time as the bag is filled with odiferous waste and is ready for removal. One embodiment even provides a welded foldable handle to which the open end of the bag is attached to enable easy removal of a waste-containing bag. Yet another embodiment requires cutting the continuous tube of film and tying a knot for subsequent removal.

These variations are offered in current waste pails sold by Munchkin Inc. and some are based on causing rotation of the waste via a resilient rubberized injection molded TPE plastic membrane. This membrane is generally designed with slits that form fingers therebetween with the fingers sufficiently spaced apart to enable entraining of waste by the membrane. If the fingers of the membrane were to be too close to each other, grab functionality would be impaired. Munchkin pails are marketed as the Munchkin Arm & Hammer Diaper Pail, the Munchkin Step Pail and the Munchkin Pail.

An improvement to the waste containers with membranes that rely on grabbing of the waste when inserted through the membrane to enable rotation of the entrained waste to form a twist in the bag or tubing that prevents odor release from the waste was sought in order to, among other things, improve odor release prevention while simplifying the components. For example, elimination of the rotational componentry would simplify design and manufacture of the waste container.

OBJECTS AND SUMMARY OF THE INVENTION

It is an object of the present invention to provide a height-adjustable waste container that includes a membrane having a unique design, configuration and characteristic hardness (durometer) and which is able to produce substantially the same or a better odor barrier effect as prior art membranes in waste disposal devices without utilizing a rotation mechanism to form a temporary twist in a bag or tubing passing through the membrane.

A container in accordance with the invention includes a telescoping wall construction defining an interior space receivable of a bag and which has wall sections positionable in a plurality of different positions to provide the wall construction with a plurality of different heights. A bag handling assembly is coupled to an upper end region of the wall construction, and includes a bag support defining an opening and having a membrane with at least one slot through which the bag passes when present. In one embodiment, the wall sections include a lowermost wall section defining a base of the wall construction, an uppermost wall section defining the upper end region of the wall construction to which the bag handling assembly is coupled, and an intermediate wall section between the lowermost and uppermost wall sections, although multiple intermediate wall sections may be provided. The wall sections preferably have the same cross-sectional shape, and when in a collapsed state, the lowermost wall section is at least partly inward of the intermediate wall section and the intermediate wall section is at least partly inward of the uppermost wall section.

The base preferably includes expansion initiation means for initiating expansion of the wall construction. Exemplifying expansion initiation means include at least one aperture in the base and a (respective) well aligning with the aperture(s) to enable manual grasping of the base via the well(s). Two apertures and two respective wells are commonly provided.

Connecting mechanisms connect adjacent pairs of wall sections together, each connecting mechanism including a ridge on an inner surface of an uppermost one of the adjacent pair of wall sections and an inwardly projecting lower flange below the ridge on the uppermost one of the pair of adjacent wall sections that form a channel therebetween and an upper flange on a lowermost wall section of the pair of adjacent wall sections that fits into the channel. There is thus engagement between the adjacent wall sections when the upper flange is in the channel. The lower flange extends from a lower edge of the uppermost one of the pair of adjacent wall sections and the upper flange extends from an upper edge of the lowermost one of the pair of adjacent wall sections. The upper and lower flanges extend substantially equal distances along a peripheral edge of the pair of adjacent wall sections.

A release mechanism is associated with each connecting mechanisms, and may be situated on the lowermost one of the pair of adjacent wall sections. An exemplifying release mechanism includes a press tab deflectable inward to release the upper flange from the channel and enable insertion of the lowermost one of the pair of adjacent wall sections into the uppermost one of the pair of adjacent wall sections.

In one embodiment, support flanges on the uppermost one of the pair of adjacent wall sections engage with support flanges on the lowermost one of the pair of adjacent wall sections.

The bag handling assembly may include springs, in which case, the wall construction includes indentations on an inner surface adapted to receive the springs such that when the springs are received in the indentations, the bag handling assembly is secured to the wall construction.

Each membrane slot may be defined by a pair of opposed walls spaced apart a distance to enable a bag, when inserted through that slot, to be pinched by the opposed walls.

Optionally, the membrane includes reinforcement ribs on a lower surface that project beyond the lower surface and extend from a central region of the membrane toward a circumferential edge of the membrane. Such reinforcement ribs may be situated between adjacent pair of the slots when multiple slots are present. Also, a durometer of the membrane is preferably selected to provide a return effect after fingers of the membrane defined between adjacent ones of the slots are pressed downward.

The bag handling assembly also includes a retainer extending inward from the wall construction at an upper end region of the wall construction. This retainer defines an opening, and the bag support is pivotally coupled to the retainer. The bag support may be pivotally attached to the retainer via cooperating hinge components on the retainer and the bag support on a first side of the opening defined by the retainer. The bag handling assembly may also include a closure component pivotally coupled to the bag support independent of the pivotal coupling of the bag support to the retainer, and which closure component also defines an opening. The bag support and closure component includes cooperating clamping structure that clamps the bag when present between the bag support and the closure component while the closure component is pivoted against the bag support. The closure component is pivotally attached to the bag support via cooperating hinge components, e.g., an additional hinge component on the bag support and a cooperating hinge component on the closure component on a second side of the opening defined by the retainer.

In another embodiment, the wall construction includes wall sections flexibly connected to one another and that bend about connection points into a folded state while connected to one another and expanded into an expanded state while connected to one another. In one specific embodiment, there is an uppermost wall section made of a rigid material, a lowermost wall section made at least partly of a rigid material and at least one intervening wall section made of thermoplastic elastomer material.

Another embodiment of the container in accordance with the invention includes a telescoping wall construction defining an interior space receivable of a bag, e.g., with a lowermost wall section defining a base of the wall construction, an uppermost wall section defining an upper end region of the wall construction, and an intermediate wall section between the lowermost and uppermost wall sections. The intermediate wall section has different positions relative to the uppermost wall section and the lowermost wall section has different positions relative to the intermediate wall section to provide the wall construction with a plurality of different heights. A bag handling assembly is coupled to the upper end region of the uppermost wall section and includes a bag support defining an opening and having a membrane with one or more slot through which the bag passes when present. Expansion initiation means are arranged in connection with the base for initiating expansion of the wall construction by moving the lowermost wall section in a direction away from the uppermost wall section. Connecting means are arranged between each adjacent pair of the wall sections for enabling the adjacent pair of the wall sections to maintain a fixed vertically expanded position.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein:

FIG. 13 is a cross-sectional view of the wall construction of the waste disposal device shown having a largest height;

FIG. 14 is an enlarged view of the connecting structure between adjacent walls sections of the wall construction of the waste disposal device;

DETAILED DESCRIPTION OF THE DRAWINGS

Figure 1:
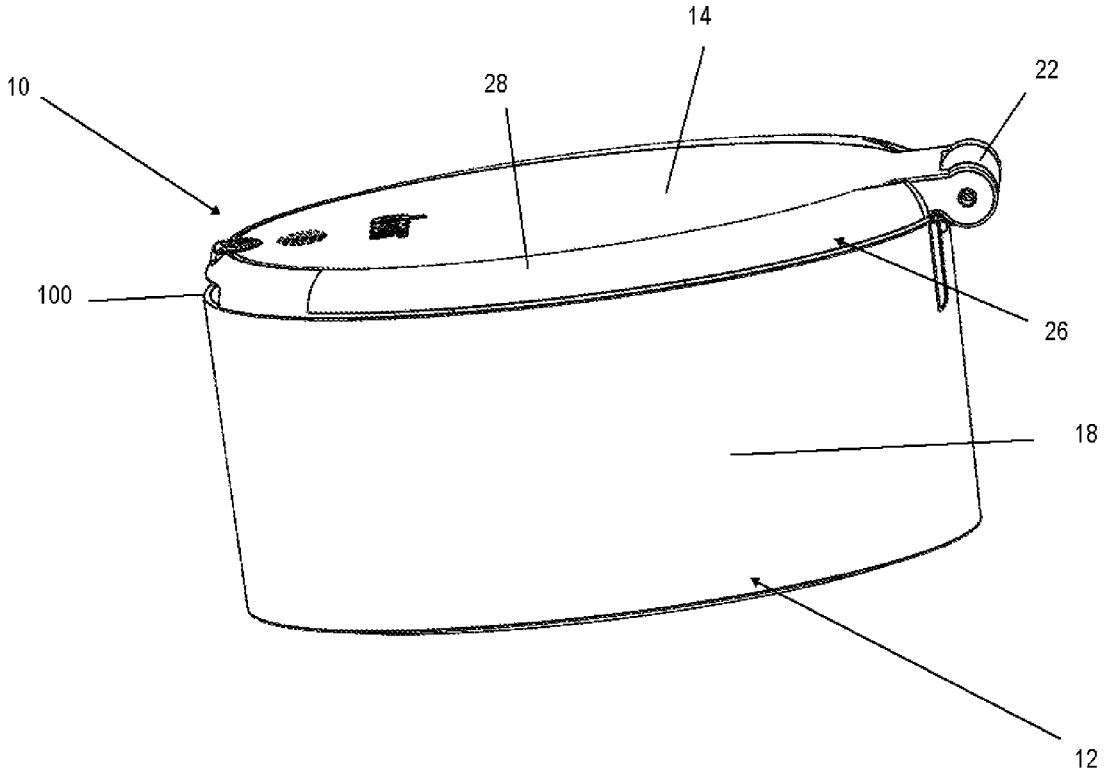
FIG. 1 is a top perspective view of a waste disposal device in accordance with the invention shown in a state in which a lid is closed and having a smallest height.
Figure 5:
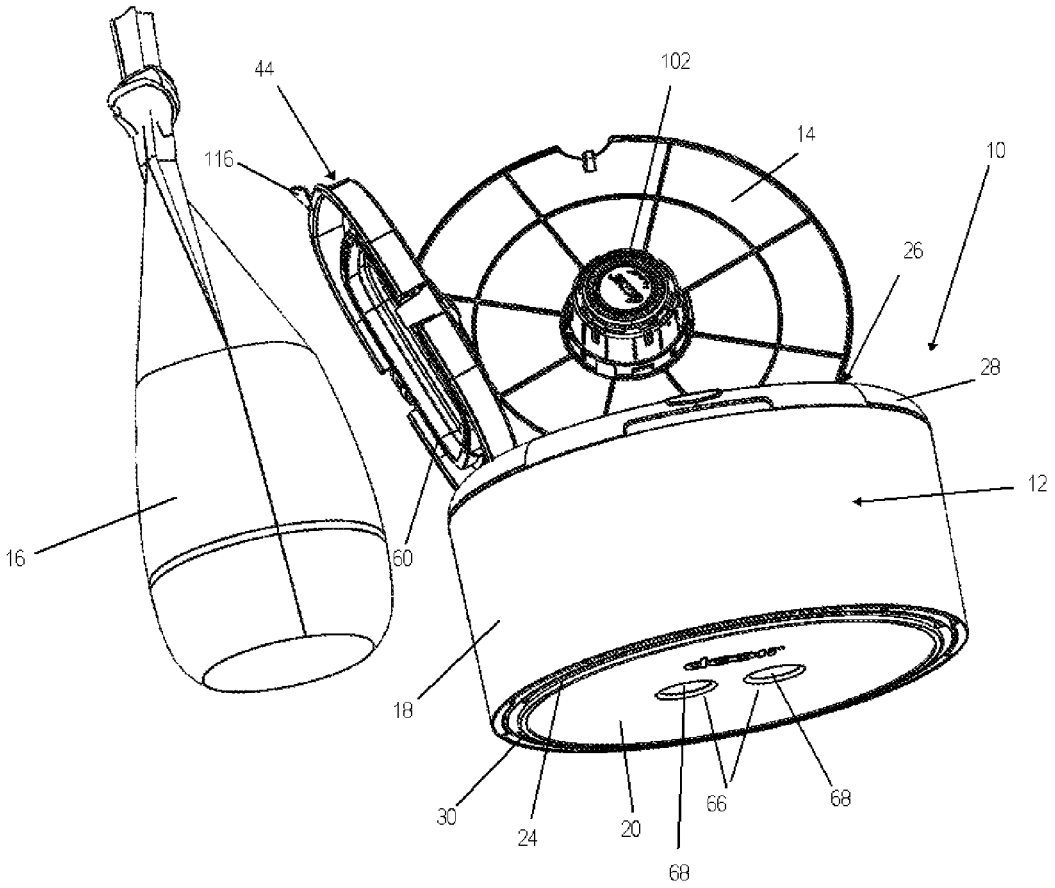
FIG. 5 is a bottom perspective view of the waste disposal device of FIG. 1 shown in a state in which the lid is open and a bag removed therefrom.
Figure 6:
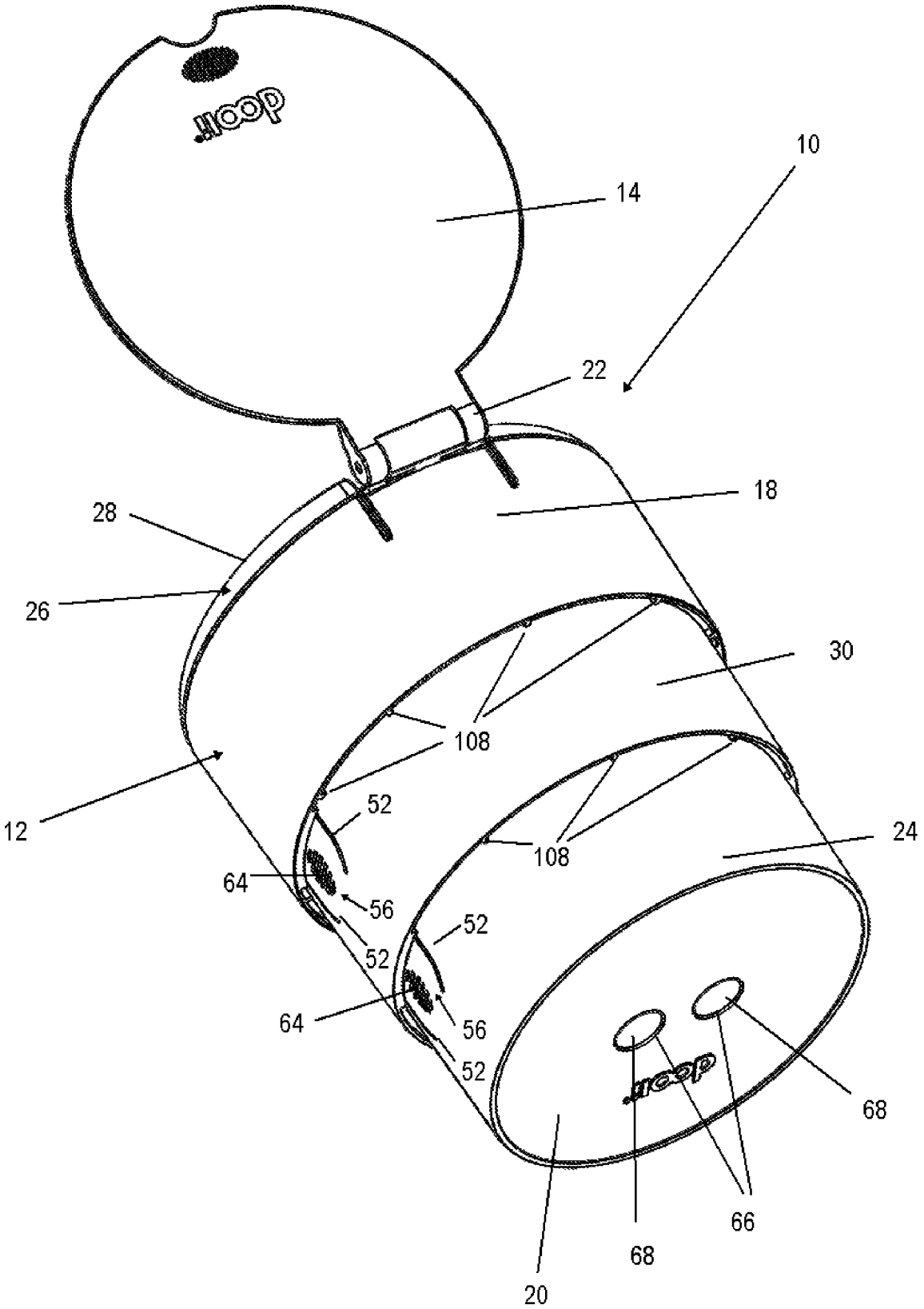
FIG. 6 is a bottom perspective view of the waste disposal device in accordance with the invention having a largest height with the lid in an open state.
Figure 7:
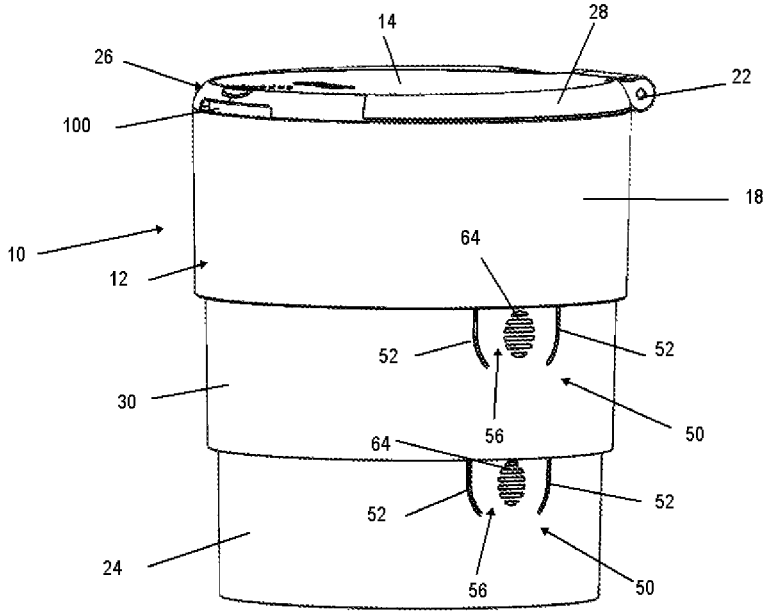
FIG. 7 is a side view of the waste disposal device in the state shown in FIG. 6 with the lid in a closed state.
Figure 9:
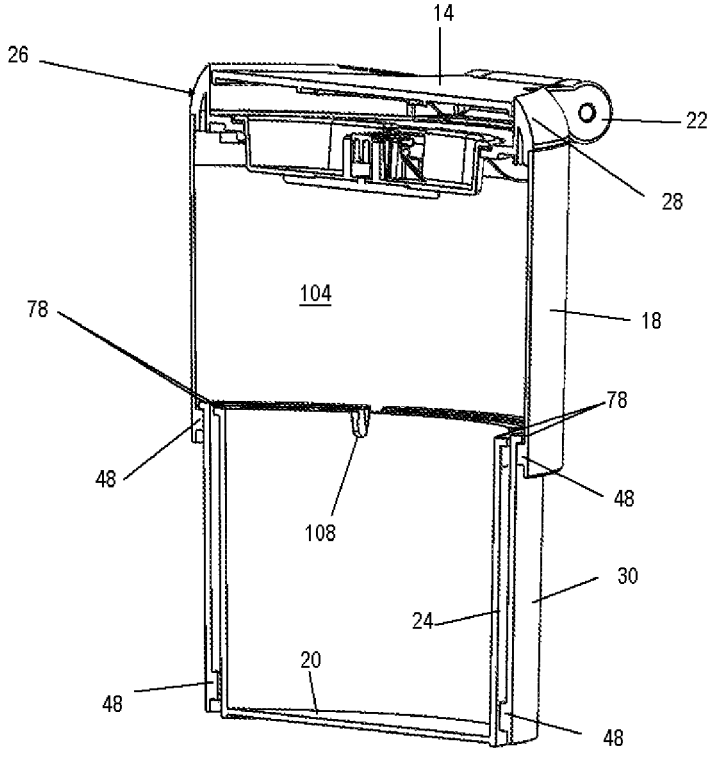
FIG. 9 is a cross-sectional view through the waste disposal device having an intermediate height.
Figure 10:
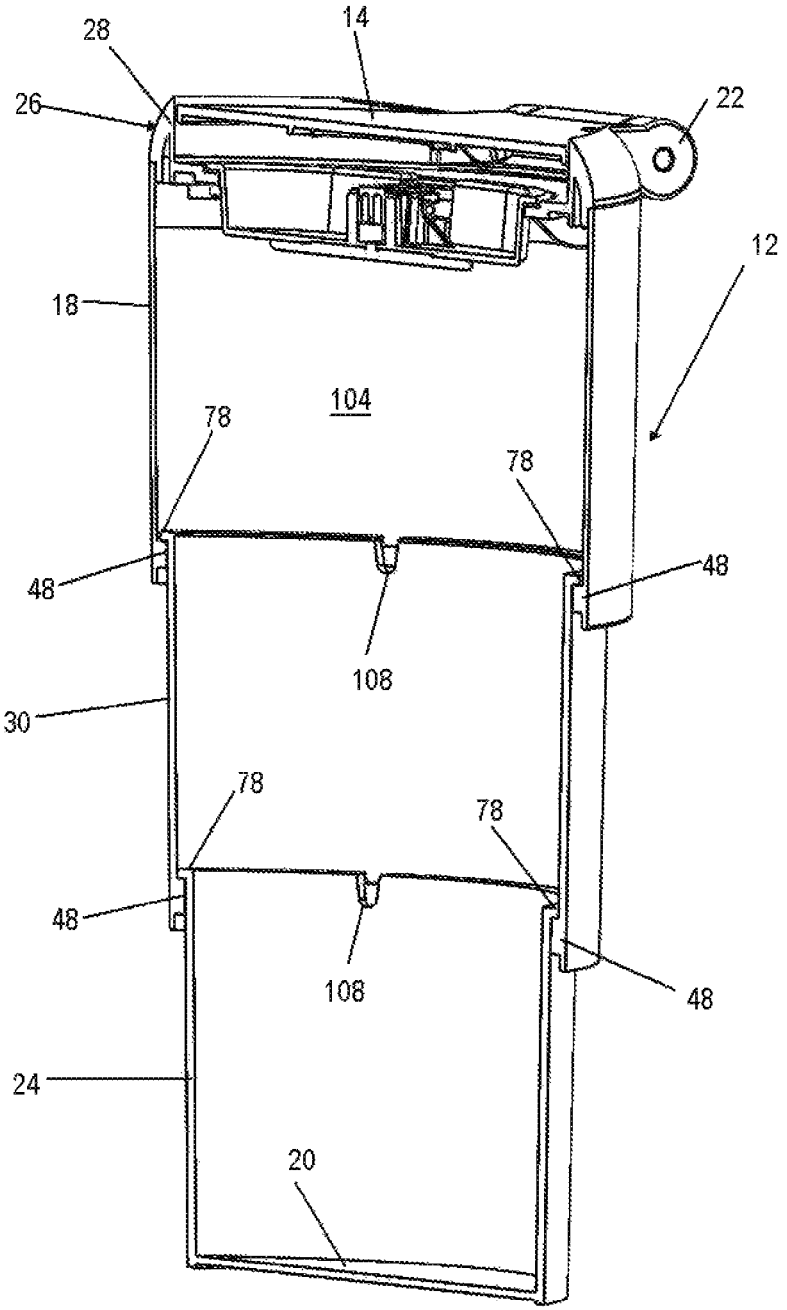
FIG. 10 is a cross-sectional view through the waste disposal device in the state shown in FIG. 6.

Referring to the accompanying drawings wherein the same reference numbers refer to the same or similar elements, FIGS. 1 and 6 are perspective views of a waste disposal device or container 10 in accordance with the invention which is preferably used to dispose of waste, but which may be used for any purpose. Waste disposal device 10 includes a wall construction 12 that enables variable operational heights of the waste disposal device 10, the smallest of which is shown in FIGS. 1-5, an intermediate one of which is shown in FIG. 9, and the largest of which is shown in FIGS. 6, 7, 10, 12 and 13. In each of the multiple variable heights, the wall construction 12 is stable and enables the waste disposal device 10 to be self-standing.

Waste disposal device 10 includes a lid 14 that has a first, closed position (FIG. 1) in which access to a bag 16 retained in the waste disposal device 10, and more generally, to an interior compartment or space 104 of the waste disposal device 10, is prevented and open position (FIG. 2) in which access to the bag 16 retained in the waste disposal device 10 is possible. The bag 16 is shown removed from the waste disposal device in FIG. 5.

Wall construction 12 represents at least one wall that defines the interior compartment or space 104 in the waste disposal device 10 that is receivable of the bag 16 into which waste is to be placed. Wall construction 12 may consist of a single wall or in the illustrated embodiments, comprises multiple wall sections that enable variable heights for the wall construction 12, and thus a plurality of heights for the waste disposal device 10.

Waste disposal device 10 is shown with the smallest height in FIGS. 1-5 and with the largest height in FIGS. 6, 7, 10, 12 and 13. The illustrated embodiment also enables a single intermediate height of the waste disposal device 10 (see FIG. 9), arising from the presence of three telescoping wall sections 18, 24, 30 in the wall construction 12. These three telescoping wall sections 18, 24, 30 may have the same height or different heights, as desired (provided a relatively outer wall section has a larger height than any relatively inner wall sections if complete telescoping is sought). Wall sections 18, 24 and 30 are shown as uniformly cylindrical but may have any cross-sectional shape, e.g., square, rectangular, oval, etc. They are preferably made of a sturdy rigid material, commonly a plastic that is able to provide axial rigidity.

More specifically, wall construction 12 includes an upper, outermost wall section 18, a lower, innermost wall section 24 and an intermediate wall section 30. The intermediate wall section 30 is radially between the uppermost wall section 18 and the lowermost wall section 24 when the waste disposal device 10 has its smallest height, i.e., in the collapsed state (see FIGS. 4 and 5). Vertically, the uppermost wall section 18 is above the intermediate wall section 30 which is above the lowermost wall section 24 when the waste disposal device 10 has its largest height, i.e., in the extended or expanded state (see FIGS. 6, 7, 10, 12 and 13). There is a small overlap between adjacent wall sections 18, 24, 30 (see FIGS. 10, 12 and 13). In this small overlapping region, the connecting mechanism that connects the adjacent wall sections 18, 24, 30 together is provided. Also, in the collapsed state, the lowermost wall section 24 is at least partly inward of, and may even be in its entirety inward of, the intermediate wall section 30, and the intermediate wall section 30 is at least partly inward of, and may even be in its entirety inward of, the uppermost wall section 18.

Although various structures are known to connect discrete telescoping wall sections together (and may be used in the invention), a preferred structure is shown in the illustrated embodiment and includes two connecting structures 34 between each pair of adjacent wall sections 18, 24, 30. Each connecting structure 34 comprises a lower flange 40 on the uppermost wall section of the pair of adjacent wall sections 18, 30 (see FIGS. 13 and 14). Lower flange 40 extends radially inward from the lower edge region of the uppermost one of the pair of adjacent wall sections 18, 30, preferably only for the distance in the circumferential direction equal to or less than the length of the connecting structure 34 in the circumferential direction (see FIG. 8). There is no connecting structure at the upper end region of the uppermost wall section 18 or at the lower end region of the lowermost wall section 24, because there are no wall sections adjacent to these end regions.

Connecting structure 34 also includes an upper flange 38 on the lowermost wall section of the pair of adjacent wall sections 24, 30 that fits into a channel between the lower flange 40 and a ridge 42 to provide for engagement between the adjacent pair of wall sections 18, 24, 30 (see FIG. 14). Ridge 42 is formed on the inner surface of the uppermost wall section of the pair of adjacent wall sections 18, 30 and may be provided with an angled surface to enable the upper flange 38 to slide over the ridge 42 into the channel and against the lower flange 40. This fit means that the thickness of the upper flange 38 is the same as or less than the thickness of the channel between the lower flange 40 and ridge 42. Preferably, the thickness of the upper flange 38 and this channel are very close to one another to provide for a secure and tight fit. Upper flange 38 extends radially outward from the upper edge of the lowermost one of the pair of adjacent wall sections 24, 30 only for the distance in the circumferential direction equal to or less than the length of a release mechanism 50 in the circumferential direction, described below.

Connecting structure 34 is not limited to the specific connecting structure as shown and includes all equivalents thereto. The term "connecting means" for connecting the adjacent wall sections 18, 24, 30 together therefore is intended to encompass the structure disclosed above, i.e., the cooperating flange 38 and channel between flange 40 and ridge 42, and other equivalent structure which is arranged in conjunction with each adjacent pair of wall sections to enable the adjacent pair of wall sections to maintain a fixed vertically expanded position. These connecting means may also constitute locking means for not only connecting the adjacent wall sections together, but also locking the adjacent pair of wall sections together in a secure, locked state.

Figure 8:
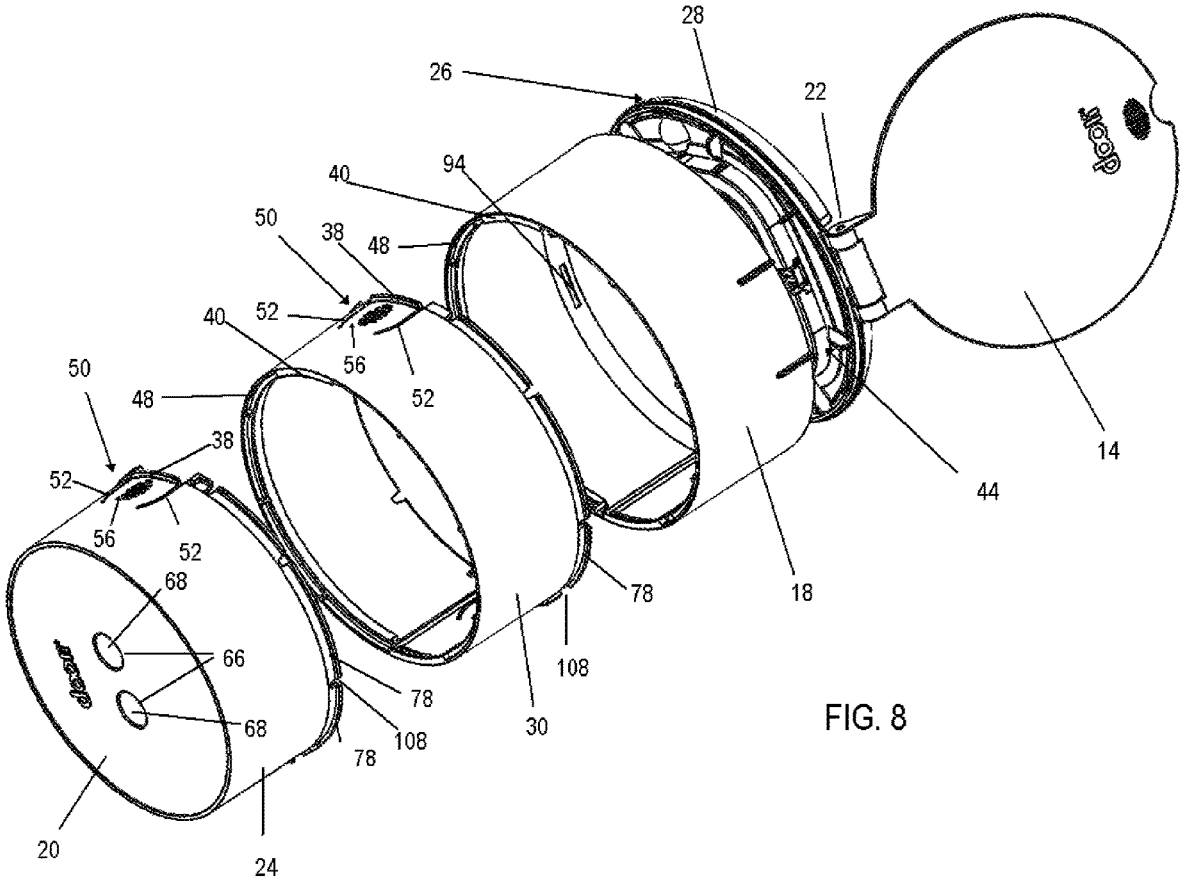
FIG. 8 is an exploded view of the waste disposal device with the lid in an open state.
Figure 11:
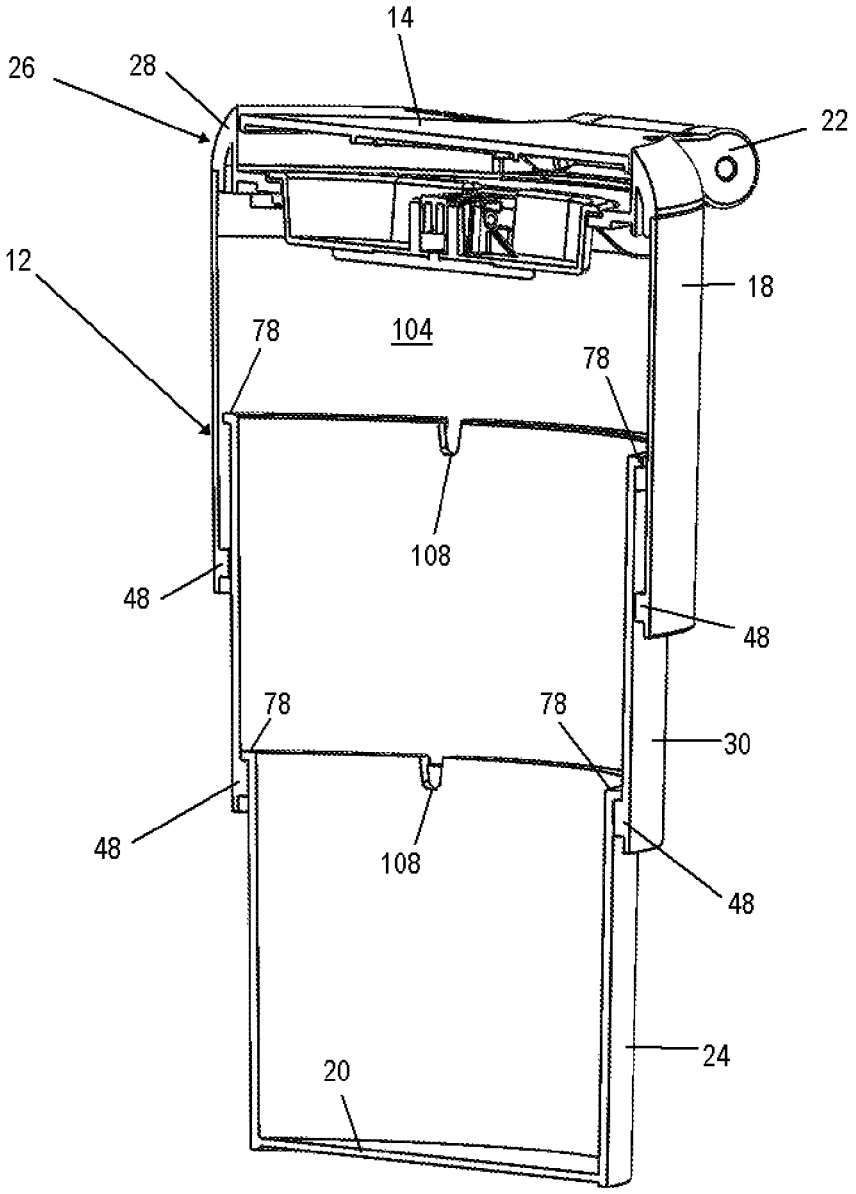
FIG. 11 is a cross-sectional view through the waste disposal device shown in an intermediate state wherein the wall construction is being expanded or collapsed.

To aid in maintaining the adjacent wall sections 18, 24, 30 in the collapsed state, the fully expanded state or any intermediate expanded states, support flanges 48 are formed at the lower edge region of the uppermost one of the adjacent wall sections 18, 30 and cooperating support flanges 78 are formed at the upper edge region of the lowermost one of the adjacent wall sections 24, 30 (see FIG. 8). The support flanges 48, 78 are separated by notches 108. When the wall sections 24, 30 are expanded, the upper support flanges 78 engage with and pull the lower support flanges 48 outward, and remain in engagement with one another (see FIGS. 10 and 11). The dimensions of each pair of cooperating support flanges 48, 78, i.e., the length in the circumferential direction, may be the same or different, so long as there is sufficient overlap, the specific degree of which would be readily ascertainable by those skilled in the art to which this invention pertains.

Waste disposal device 10 also includes a base 20 on which the wall sections 18, 24, 30 are supported, and a cooperating hinge 22 that pivotally couples the lid 14 to the wall construction 12, typically the uppermost wall section 18, to enable movement of the lid 14 between its open and closed positions. The base 20 may be integrated into the wall construction 12, e.g., connected to the lowermost wall section 24. Base 20 may be formed integral with the lowermost wall section 24, i.e., as a single unit or element.

To expand the wall construction 12 in an exemplifying manner, the user is able to insert their fingers through apertures 66 in the base 20 into cavities 68 of the waste disposal device 10 and pull the base 20 away from the uppermost wall section 18, e.g., while holding the uppermost wall section 18. It is also possible to place the waste disposal device 10 upside down on a flat surface and pull the base 20 upward, and then flip the waste disposal device 10 over for use. It is also possible to grasp the uppermost wall section 18 on opposite sides and lift it upward while the base 20 is on a flat surface, applying force if necessary to obtain the fully open position.

The wall construction 12 opens to a click stop, with the upper flanges 38 sliding along an angled upper surface of the ridge 42, then over the ridge 42 into the channel against the lower flange 40 to form a positive lock stop for that wall section. The user can continue to pull the base 20 away from the uppermost wall section 18 until wall section 24 clicks into place with wall section 30 and until wall section 30 clicks into place with wall section 18.

Figure 12:
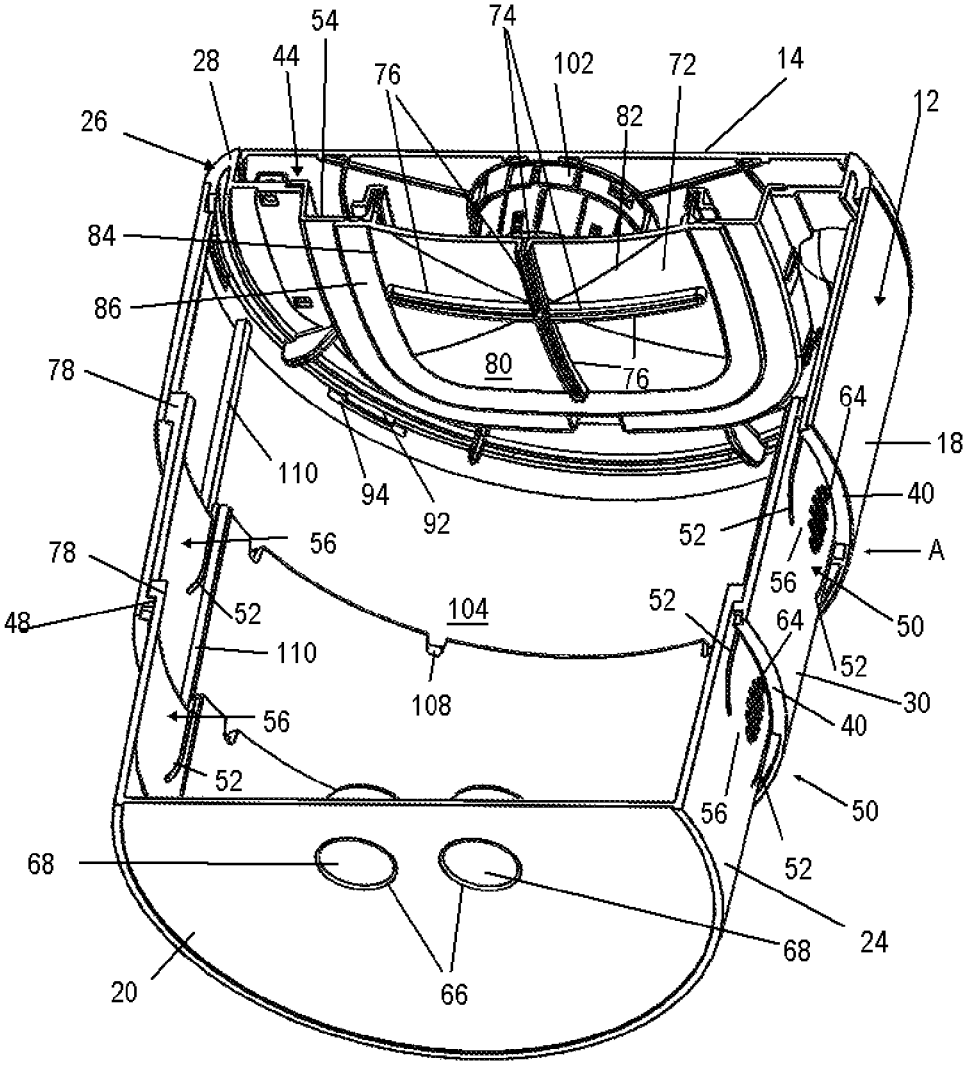
FIG. 12 is another cross-sectional view through the waste disposal device in the state shown in FIG. 6.

Movement of the upper flanges along the inner surface of the uppermost one of the adjacent pair of wall sections 18, 30 is guided by a pair of rails 110 on the inner surface of the uppermost one of the adjacent pair of wall sections 18, 30 (FIGS. 8, 12 and 13). Other structure to guide the vertical movement of the upper flange along the inner surface of the wall section may be used in the invention and is considered to be encompassed within the term guide means for guiding vertical movement of the upper flange. Only the intermediate wall section 30 and the uppermost wall section 18 are provided with guide rails 110, since only the lowermost wall section 24 and the intermediate wall section 30 are provided with the upper flange 38 that are guided by the rails 110.

Inadvertent collapsing of the wall construction 12 is prevented because the upper flange 38 is secured in the channel between the lower flange 40 and the ridge 42. The lower surface of the ridge 42 is not angled so that if pressure is exerted upward against the wall construction 12, the upper flange 38 cannot ride over the ridge 42. Rather, only inwardly exerted pressure against a press tab 56, described below, can cause the upper flange 38 to move over the ridge 42 and enable collapsing of the wall construction 12.

Apertures 66 leading into cavities 68 in the base 20 represent expansion initiation structure to enable the wall construction 12 to be expanded from a relatively collapsed state or condition to a relatively expanded state or condition. The number of apertures 66 and cavities 68 may vary from the two as shown, including possibly only a single aperture 66 and respective cavity 68 or three or more apertures 66 and respective cavities 68. It is also possible to form two apertures 66 leading into a common cavity 68 and therefore enable a user to grasp a portion of the base 20 between the apertures 66 and pull this portion outward away from the uppermost wall section 18 to thereby expand the wall construction 12.

Yet another possible expansion initiation structure is to form the base with a bottom wall recessed below a surrounding portion and one or more raised ribs that extends downward from the lower surface of the bottom wall no further than the height of the surrounding portion (to enable the waste disposal device 10 rest securely on a flat, horizontal surface). For this embodiment, the user would grab the raised rib and pull the base 20 outward away from the uppermost wall section 18 to thereby expand the wall construction 12.

Still another possible expansion initiation structure is a handle pivotally connected to the base 20, e.g., the lower surface of the base 20, and which is normally stored in a position in a cooperating recess in the base 20 but which can be swung open and then pulled to thereby pull the base 20 outward away from the uppermost wall section 18 in order to expand the wall construction 12. This recessed handle could be curved or U-shaped and pivot relative to a pivot structure arranged on the base 20. Once the base 20 is pulled outward away from the uppermost wall section 18 to provide the wall construction 12 with the desired height, the handle is snapped back into its recess in the base 20.

Any of the foregoing expansion initiation structure is encompassed within the term expansion initiation means, along with equivalents thereof. Incorporating such means into the base 20 provides for easy expansion of the wall construction 12 to any of its possible heights.

Once the wall construction 12 is in an expanded state, when it is desired to collapse the wall construction 12, releasing of the lock between each pair of adjacent wall sections 18, 24, 30 to collapse the adjacent wall sections 18, 24, 30 is accomplished by pressing the lowermost wall of the adjacent wall sections 24, 30 inward at one or (as shown) two places to temporarily spring-deflect the engagement (move the upper flange 38 inward) to freely allow the lowermost wall section 24, 30 of the adjacent wall sections to move into the uppermost wall section 18, 30 of the adjacent wall sections. The person should move their fingers away from the lowermost wall 24, 30 of the adjacent wall sections as the uppermost wall 18, 30 of the adjacent wall sections collapses.

More specifically, release mechanism 50, one of which is associated with each connecting structure 34, may comprise a pair of slots 52 in the lowermost wall section of the pair of adjacent wall sections 24, 30 that define the press tab 56 therebetween. Slots 52 may have different shapes but in the illustrated embodiment, gently curve inward toward one another at an end distant from the upper edge of the wall sections 24, 30 (see FIGS. 7 and 8). The slots 52 enable the press tab 56 to be pressed inward. Press tab 56 generally aligns with the upper flange 38, i.e., there is a slot 52 at or beyond each end of the upper flange 38. An indicator 64 is preferably provided on the press tab 56, e.g., a series of ridges or apertures that indicate the presence of the press tab 56. Upper flange 38 may be considered part of the release mechanism 50 as well as part of the connecting structure 34.

When pressed inward, the press tab 56 causes the upper flange 38 to be moved radially inward out of the channel between the lower flange 40 and the ridge 42 and allows for collapsing of the pair of adjacent wall sections 18, 24, 30. The user merely moves the lowermost wall section of the pair of adjacent wall sections 24, 30 upward until the upper flange 38 rides over the ridge 42 and then releases the pressing force of the press tab 56. The upper flange 38 can move upward along the rear side of the ridge 42 which is angled downward. Provided the user presses all of the press tabs 56 on lowermost one of the pair of adjacent wall sections 24, 30, preferably at about the same time, and continues the upward movement of the lowermost one of the pair of adjacent wall sections 24, 30, the lowermost one of the pair of adjacent wall sections 24, 30 can be slid into or behind the uppermost one of the pair of adjacent wall sections 18, 30 thereby collapsing the pair of adjacent wall sections 18, 24, 30.

The user continues in the same manner to either collapse all of the expanded wall sections or only those wall sections that provide the final, desired shortened height for the waste disposal device 10.

The press tabs 56 constitute springs that are biased radially outward yet pressable radially inward. The characteristics of the slots 52 from the upper edge of the wall section, e.g., their length in the direction away from the upper edge and thickness between opposing edges, determines the bias, resiliency and springiness of the press tab 56, among other properties readily ascertainable by those skilled in the art to which this invention pertains. Another factor is the material from which the press tabs 56 are made.

Generally, the release mechanism 50 is therefore based on the formation of part of the lower wall section (of an adjacent pair of wall sections 18, 24, 30) with a spring that must be pressed inward to cause release of the upper flange 38 which projects radially outward. The press tab 56 therefore has a sort of L-shape cross-section over at least a part thereof with the body of the press tab 56 being pressed radially inward (direction of arrow A in FIG. 12) moving the outwardly projecting upper flange 38 out of the channel between the lower flange 40 and the ridge 42.

In the illustrated embodiments, there are two cooperating arrangements of the connecting structure 34 and release mechanism 50 on each pair of adjacent wall sections 18. 24. 30, preferably opposite one another, i.e., on opposite sides of the wall sections 18, 24, 30. It is possible to provide additional cooperating arrangements, for example, if additional structural rigidity of the waste disposal device 10 in its expanded state is desired since each connecting structure 34 adds rigidity and stability to the expanded waste disposal device 10. Alternatively it may also be possible to provide only a single cooperating arrangement, i.e., a single connecting structure 34 and associated release mechanism 50.

The circumferential length of the press tabs 56 may be determined by those skilled in the art to which this invention pertains based on the dimensions of the wall sections 18, 24, 30. For wall sections 18, 24, 30 having a circumference of about 24-30 inches, it is possible to provide two cooperating arrangements of connecting structure 34 and release mechanism 50 wherein each has a length of about 2-3 inches and they are diametrically opposite one another. Thus, for example, the press tabs 56 would each have a length of 2 inches providing the upper flange 38 with this length or a smaller length.

It can be appreciated that since the cooperating arrangements between adjacent wall sections 18, 24, 30 are independent of one another, i.e., the cooperating arrangement between walls sections 18 and 24 has no dependence on the cooperating arrangement between walls sections 24 and 30, it is possible to expand the waste disposal device 10 so that only the lowermost wall section 24 is extended (the intermediate wall section 30 being retained within the uppermost wall section 18). In this use, the waste disposal device 10 has a general height (not including the height of the bag handling assembly 26) which is the combined height of the lowermost wall section 24 and the uppermost wall section 18. It is also possible to expand the waste disposal device 10 so that both the lowermost wall section 24 and the intermediate wall section 30 are extended (FIGS. 6, 7, 10, 12 and 13). In this use, the waste disposal device 10 has a general height which is the combined height of the lowermost wall section 24, the intermediate wall section 30 and the uppermost wall section 18.

It is also possible to use the waste disposal device 10 with only the intermediate wall section 30 extended as shown in FIG. 9 (e.g., by first extending the wall construction to the maximum height and then collapsing the lowermost wall section 24). In this use, the waste disposal device 10 has a general height which is the combined height of the intermediate wall section 30 and the uppermost wall section 18 (the lowermost wall section 24 being retained within the intermediate wall section 30). Finally, it is possible to use the waste disposal device 10 without the lowermost wall section 24 or the intermediate wall section 30 extended. In this use, the waste disposal device 10 has a general height which is the height of only the uppermost wall section 18 (see FIGS. 1-5). Of course, providing four or more wall sections expands the number of possible heights of the waste disposal device 10.

A control mechanism to effect opening or closing of the lid 14 may be provided, as known to those skilled in the art to which this invention pertains. Such control mechanisms may be concealed in the uppermost wall section 18 and/or the base 20 of the waste disposal device 10. Another such mechanism is a simple push to open the lid 14 by, for example, pressing the front top and in turn closing the lid 14 by pressing the lid 14 down. This is common and well known. The lid 14 may include a cut-out at its front edge to enable it to be lifted.

In a particularly advantageous embodiment, waste disposal device 10 includes a bag handling assembly 26 that has three main parts. Bag handling assembly 26 may have a unitary structure which is formed as a unit and then attached to the wall construction 12 of the waste disposal device 10, typically to the uppermost wall section 18. Bag handling assembly 26 may be an insert that is removable as a unit from the coupling to the uppermost wall section 18.

In a preferred embodiment, there is a connect/disconnect mechanism provided to couple the bag handling assembly 26 to the wall construction 12, specifically, to the uppermost wall section 18. Generally, the connection mechanism can be an over-molded rubberized full round or interrupted pliable durometer gasket ring (for example Shore 45A-Shore 75A) that forms a snug interference fit for secure engagement of the bag handling assembly 26 and at the same time can be easily removed with some exertional force or springs interacting with inner wells of the uppermost wall section 18. Either construction allows for easy exchange of the bag handling assembly 26 relative to a wall construction of a waste disposal device, whether the wall construction 12 of the waste disposal device 10 as disclosed herein or another wall construction of another waste disposal device. This preferably rapid connect and rapid disconnect of the bag handling assembly 26 is an important aspect of the invention relating to its portability and compact storage. Indeed, in both embodiments, there will be a retention of the bag handling assembly 26 causing it to remain in place until such time as removal for storage, exchanging one bag handling assembly for another or cleaning is required.

In one embodiment, the bag handling assembly 26 is provided with snaps or springs 92 that snap engage into indentations 94 on the inner surface of the uppermost wall section 18 (see FIG. 12). There may be any number of cooperating springs 92 and indentations 94 around the circumference of the bag handling assembly 26 and uppermost wall section 18. Springs 92 are formed to provide flexibility and enable the lower ends of the springs 92 to flex inward during downward movement of the bag handling assembly 26 against the inner surface of the uppermost wall section 18 and then flex outward into the indentations 94 thereby securing the bag handling assembly 26 to the uppermost wall section 18. A lower end of the springs 92 may be provided with an angled surface, and a lower hook portion that prevents inadvertent separation of the bag handling assembly 26 from the wall section 18.

Indentations 94 may differ from the specific shape as shown. It is preferable to provide the upper edge of each indentation 94 with a curvature, as opposed to a sharp perpendicular edge to better allow for insertion and removal of the springs 92, which are also preferably provided with a curvature at a corresponding location on the hook portion. These cooperating curvatures allow the springs 92 to more easily slide in and out of the indentations 94.

In an embodiment wherein the gasket ring is provided, it may be interposed between a circumferential edge of the bag handling assembly 26 and the uppermost wall section 18. Gasket ring may be an over-molded or add-on gasket ring having a reasonably soft durometer (Shore 45A-65A and possibly even up to 75A) and creates a sufficient interference fit providing a temporarily tight seal. For this embodiment, the uppermost wall section 18 is not required to have indentations 94. However, to enable removal of the bag handling assembly 26 from the wall construction 12, side wells may be formed in the bag handling assembly.

Removal of the bag handling assembly 26 from engagement with the wall construction 12 is generally obtained by pressing the bag handling assembly 26 inward from its circumferential edge in the region of the springs 92. The springs 92 are caused to pop out of the indentations 94 and the user then lifts the bag handling assembly 26 upward and away from the wall construction 12.

More specifically, removal of the bag handling assembly 26 from engagement with the uppermost wall section 18 may be by pressing the springs 92 inward to disengage them from the indentations 94 and then pulling the bag handling assembly 26 upward. Springs 92 are therefore constructed to be spring back a little to enable easy removal of the springs 92 from the indentations 94, yet also prevent inadvertent separation as a result of the cooperating curvatures of the springs 92 and indentations 94. The thickness of the uppermost wall section 18 is likely to be about 2 mm to about 3 mm thick, which in itself, as polypropylene, is flexible enough to move a bit in assisting engagement and disengagement.

Also, the bag handling assembly 26 is provided with a front well 100 for removal of the bag handling assembly 26 from engagement with the wall construction 12.

The first part of the bag handling assembly 26 is a retainer 28 that extends inward from the uppermost wall section 18 and when formed separate therefrom, may be coupled to the uppermost wall section 18. Retainer 28 may be an integral part of the waste disposal device 10 or a separate component that may be temporarily or permanently attached to the uppermost wall section 18 or another part of the waste disposal device 10 to provide a secure base for the remaining parts of the bag handling assembly 26. The retainer 28 may be attached to the uppermost wall section 18 by structure disclosed in U.S. Ser. No. 10/053,283. The retainer 28 may also be molded together with the uppermost wall section 18 if so desired. Any structure which connects the retainer 28 to the uppermost wall section 18 may be considered coupling means for coupling the retainer 28 to the wall construction 12. One skilled in the art of containers would understand that such coupling means encompass a wide variety of structure known to those skilled in the plastics manufacturing field.

Retainer 28 generally has the same shape as the cross-sectional shape of the uppermost wall section 18 but this is not a limitation on the retainer 28. The term "coupled to" or variants thereof when used to describe a functional relationship between two components means that one component may be attached to the other component directly or may be attached indirectly to the other component via one or more other components.

Retainer 28 may have characteristics like the retainer in U.S. Ser. No. 10/053,283, for example, a substantially planar rim portion 32 and a hinge component 36 arranged on, coupled to or integrated into the rim portion 32. Rim portion 32 has a planar portion whose outer circumference is like the inner circumference of the region of the uppermost wall section 18 to which it is coupled and an inner circumference like the outer circumference of the inward part of the bag handling assembly, i.e., a bag support 44.

The second part of the bag handling assembly 26 is thus the bag support 44 which includes a hinge component 46 that mates with hinge component 36 to enable the bag support 44 to pivot relative to the retainer 28. Bag support 44 has a generally annular form defining an opening, annular being used herein to mean defining an opening without limiting the shape of the bag support 44.

The structure of the hinge components 36, 46 may be any known type of structure which includes a part on each of two components with these parts interacting to allow for pivotal movement, whether a hinge or referred to by another commercial name. Such hinge components 36, 46 are well-known to those skilled in the field of hinges and more generally pivotal attachment structure. Exemplifying embodiment of the hinge components 36, 46 are disclosed in U.S. Ser. No. 10/053,283, which also describes additional features of the bag support 44. A hinge component 58 is arranged on or integrated into a lower wall 54 of the bag support 44.

The third part of the bag handling assembly 26 is a closure component 60 which includes a hinge component 62 that mates with hinge component 58 to enable the closure component 60 to pivot relative to the bag support 44. Hinge component 62 projects from an annular part of the closure component 60 by an extension piece, annular being used herein to mean defining an opening without limiting the shape of the closure component 60.

The structure of the hinge components 58, 62 may be any known type of structure which includes a part on each of two components with these parts interacting to allow for pivotal movement, whether a hinge or referred to by another name. Such hinge components 58, 62 are well-known to those skilled in the field of hinges and more generally pivotal attachment structure. Exemplifying embodiment of the hinge components 58, 62 are disclosed in U.S. Ser. No. 10/053,283.

The combination of the hinge components 58, 62 (second attachment means) are situated radially inward of the combination of the hinge components 36, 46 (first attachment means) because the closure component 60 is smaller in size than the bag support 44, and the bag support 44 is smaller in size than the retainer 28.

When the closure component 60 is in a down position against the bag support 44, the bag 16 is pressed between the closure component 60 and the bag support 44. More specifically, the closure component 60 defines a channel on an underside that is receivable of an inner wall of the bag support 44 such that upon pivoting of the closure component 60 into engagement with the inner wall, the bag 16 when present is clamped between the closure component 60 and the inner wall. This channel is generally defined by two spaced apart walls and bottom wall to form the downwardly oriented channel. Closure component 60 thus has a generally square shape like the shape of the inner wall, although their shapes may vary. The "general" square shape of the closure component 60 means that the closure component 60 has four sides but not necessarily that the edges of these sides that meet one another are exactly perpendicular to one another. The meeting edges may be curved as shown and the opposed sides of the closure component 60 are not required to be exactly linear and parallel to one another.

Bag support 44 therefore serves two important functions, first to provide a pivotal attachment to the retainer 28 to enable access to an interior of the waste disposal device 10 for removal of the bag 16 when it has been used to hold for example waste, and second to provide the inner wall to allow for selective clamping of an open end of the bag 16 by the closure component 60 against this inner wall. This clamping is a contact pressing with the bag 16 being pressed by the closure component 60 against the inner wall to thereby trap odor arising from material in the bag 16 inside of the bag 16. When the bag is not present, there may be contact between the closure component 60 and the inner wall or only a slight allowance of less than the thickness of a bag expected to be used in the waste disposal device 10.

The closure component 60 is not a required component and the bag handling assembly 26 may include only the retainer 28 and the bag support 44. In such an embodiment, the bag 16 is retained between bag support 44 and the retainer 28. Specifically, the bag support 44 is lifted up relative to the retainer 28 and the open edge of the bag 16 is placed alongside the retainer 28 and then the bag support 44 is pivoted downward to sandwich the open edge region of the bag 16 against the retainer 28 and thereby secure the bag 16 in the waste disposal device 10.

As to the former function, the bag support 44 can be pivoted upward by the cooperating hinge structure 36, 46 to enable access to the bag 16, and notably removal of a bag 16 containing waste while the bag support 44 is pivoted upward relative to the retainer 28. It is not required that the closure component 60 be pivoted upward away from the bag support 44 when the bag support 44 is pivoted upward relative to the retainer 28 to remove a bag from the waste disposal device 10.

Closure component 60 includes an optional tab 112 opposite the hinge component 62, and an optional flexible retainer 114 is arranged on the bag support 44, e.g., on the lower wall 54 of the bag support 44. The tab 112 can be pressed under a lip of the retainer 114 to thereby secure the closure component 60 to the bag support 44 and prevent upward pivotal movement of the closure component 60 relative to the bag support 44. To release the tab 112 from the retainer 114, the retainer 114 is flexed outward allowing the tab 112 to be lifted upward. Additional details of the cooperation of a tab and retainer are disclosed in U.S. Ser. No. 10/053,283 and the inventor's earlier U.S. patent application Ser. No. 15/413,163 filed Jan. 23, 2017, Ser. No. 14/935,835 filed Nov. 9, 2015, Ser. No. 14/709,878 filed May 12, 2015, Ser. No. 14/537,044 filed Nov. 10, 2014, Ser. No. 14/109,270 filed Dec. 17, 2013, 61/881,386 filed Sep. 23, 2013, and Ser. No. 16/207,338 filed Dec. 3, 2018, all of which are incorporated by reference herein.

Instead of the cooperating tab 112 and retainer 114, other structure may be provided on and/or integrated into the bag support 44 and the closure component 60 to enable the closure component 60 to be temporarily secured to the bag support 44 during use of the waste disposal device 10. Generally, such structure will be referred to as securing means for securing the closure component 60 to the bag support 44.

Bag support 44 includes a membrane 72 that may be integrated into the bag support 44 by attaching it to the inner wall and/or the lower wall 54. Membrane 72 may be a separate component from the bag support 44 and attached thereto. It may be injection overmolded, two-shot injection molded, or even press fit and possibly offered commercially with one or more membranes of different durometer or reinforcement to address the desired specific end use. For example, offensive odor or hazardous matter may be advantageously remediated by one such specified configuration (durometer and reinforcement structure-described below) while general household (kitchen waste) may be advantageously remediated by another resilient membrane with a softer durometer and fewer reinforced ribbing, etc. The ability to interchange membranes may offer a manufacturing advantage insofar as it provides a simplicity in keeping parts in stock and all remaining parts are common except for the specific membrane to perform a desired functionality directed to a given industry.

In a preferred embodiment, the membrane 72 includes four slots 74 arranged such that one pair of slots 74 aligns with one another and the other pair of slots 74 aligns with each other, with the aligning pairs of slots intersecting at an angle of about 90 degrees (see FIG. 12). Each slot 74 may be defined by a pair of substantially parallel walls (although they can also be interrupted so long as the bag is pinched). Continuous parallel walls creating a substantial narrow slit is a more positive means to retain (keep) offensive odors and germs in the portion of the bag 16 below the membrane 72. Close walls 76 will likely give the best odor barrier results. Walls 76 are spaced apart from one another and extend between a central region of the membrane 72 and a curved connecting wall proximate a circumferential edge 84 of an elastic portion of the membrane 72. By the opposed walls 76 being substantially parallel, it is meant that the walls 76 do not have to be spaced apart the same distance along their entire length but that there may be a variation in the spacing between the opposed walls, including a progressive variation from one end of the slot 74 to the other end of the slot 74.

It is possible to vary the number of slots 74, more or less than the four as shown, and form each of these slots 74 from a respective pair of parallel walls 76 that extend from a point proximate an edge of the membrane 72 to or approximately to the center of the membrane 72. That is, a membrane in accordance with the invention may include only three slots 74, each extending from a point proximate a circumferential edge 84 of the membrane 72 to or approximately to the center of the membrane 72. Each slot 74 does not have to align with another slot 74, but rather, there may be equiangularly spaced on the membrane 72. Similarly, there may be any number of slots 74 equiangularly spaced on the membrane 72. When four or more slots 74 are formed on the membrane 72, one or more pairs of slots 74 may align with one another (alignment in pairs). Alignment of slots 74 means that the two slots 74 form a continuous channel through the center or central region of the membrane 72.

It is expected that providing fewer slots 74 offers added strength to the membrane 72 and provides a less complicated return of the membrane 72 to its previous unstressed state.

With the disclosed formation of the membrane 72, it becomes possible to push the bag 16 through the membrane 72 such that a portion of the bag 16 is received in each slot 74. The bag 16 is thus held by the membrane 72 while preventing release of odor from any waste in the bag 16. An added odor prevention feature is that the slots 74 can be configured to cause bunching of the bag 16 (discussed further below).

A waste item is inserted into the waste disposal device 10 through a bag 16 overlying the membrane 72. The waste item is pushed, either manually or by structure, against the membrane 72 to cause the fingers of the membrane 72 to separate from one another and enable the waste to pass through the membrane 72.

The parallel walls 76 and curved wall extend below the lower surface 80 of the membrane 72. The height of this extension may be dimensioned in accordance with the desired goals of the membrane 72 discussed below, notably, sealing the bag 16 when passing through the slots 74.

Membrane 72 optionally includes supporting or reinforcement ribs 82 on its underside (extending downward from or above the lower surface 80) to aid in the return of the membrane 72 toward its original or previous state (FIG. 12). Each rib 82 extends radially outward from a central region of the membrane 72 toward the circumferential edge 84. The inner edge of each rib 82 may be positioned at any location between two adjacent slots 74, although spaced apart equally from the adjacent slots 74 may be most desirable. Ribs 82 are preferably linear, i.e., straight from the central region toward a point proximate the circumferential edge 84 of the membrane 72.

Membrane 72 includes a first elastic portion in which the slots 74 are formed and on which the ribs 82 are formed, and a second portion 86 around and radially outward of the circumferential edge 84 (see FIG. 12). This second portion 86 may be made of an inelastic material and provides support to the elastic portion. The membrane 72 is supported by the bag support 44 by providing a support rim or lip for the inelastic portion 86 on, for example, an inner circumferential surface of the bag support 44, or pressing part of the inelastic portion 86 through an aperture in a lower wall 54 of the bag support 44. The manner in which the membrane 72 is supported by the bag support 44 by its inelastic portion 86 is not material to the invention and any type of support structure is encompassed within the scope of the invention.

Each rib 82 may be formed by a raised portion of the membrane 72 that extends from about 2 mm to about 3 mm above the lower surface 80 of the membrane 72. In this connection, the term "above" means that if the membrane 72 were to be turned over and the lower surface 80 faced upward, the ribs 82 would be higher than the lower surface 80. However, when the membrane 72 is in place, the ribs 82 extend in the direction toward the bottom of the waste disposal device 10.

Each rib 82 preferably has a thickness between about 2 mm and 5 mm. The height above the lower surface 80 of the membrane 72 can vary from a smallest height proximate the central region to a largest height proximate the circumferential edge 84. These dimensions can be changed so they are merely suggestions. Indeed, the above range is not meant to be limiting because, among other reasons, membranes 72 with different characteristics will enable formation of ribs 82 with a different range of thickness. As an alternative configuration of a reinforcement structure, instead of a single relatively thick rib 82, it is possible to provide two supporting ribs of thinner wall thickness parallel to each other. Accordingly, the length of the reinforcement structure (one or two ribs) and the thickness of each rib are variable and different numbers of ribs and different rib thicknesses could provide the same or similar results.

Although the membrane 72 may have four ribs 82 spaced approximately ninety degrees apart from one another, this configuration is not limiting. The membrane 72 may include any number of ribs 82, i.e., one or more, and there are not required to be situated equiangularly around the membrane 72.

Adding the reinforcement ribs 82 to the membrane 72 improves the resiliency of the membrane 72, increasing the inherent force in the membrane 72 that urges the membrane 72 to return to its previous state prior to waste insertion. As mentioned above, return of the membrane 72 toward and ideally to its previous, closed state, produces an effective barrier or odor containment shield.

Reinforcement ribs 82 may be helpful in the event the bag 16 below can be heavy when filled. The width of each rib 82 and the length of the rib 82 can be molded to form a substantial reinforcement to return the membrane 72 to its previous state after waste insertion. Each rib 82 can be at least as wide and at least as high as the typical thickness of the membrane 72 minimally, to as much as twice that. The length of each rib 82 may remain the same height or taper and run from the central area of the membrane 72 to the end (or short of the end) of the outer circumferential edge 84. Each rib 82 will significantly assist the membrane 72 to remain reasonably stable under excessive pressure. The selected membrane durometer, coupled with the rib 82 in combination will accomplish this.

The thickness of the membrane 72 should be ideally at least about 0.06 inches, i.e., 0.06 inches or more, depending on the durometer, and the width of the reinforcing ribs 82 should be reasonably the same height as the thickness of the membrane 72, and the length of each slot 74 may be approximately the entire distance from the center of the membrane 72 to the circumferential edge 84. The length of the slots 74 is a variable parameter that should be considered when designing the membrane 72 since shorter slots can bunch up the bag or tubing and such bunching contributes to better sealing of the opening of the bag (and thus improves the odor barrier).

Another variable parameter that can be adjusted is the width of the slots 74, i.e., the separation distance between the parallel walls 76. The substantial closeness of the parallel walls 76 to one another improves the reinforcement provided by the walls 76. One reason is that once waste is inserted through the bag 16, and in turn the slots 74, it is the close width of the slot 74 that has the most return effect. For example, if a slot 74 is about 0.03 inches wide and a bag or tubing is inserted through it, the slot 74 forces the bag or tubing to bunch up and form numerous creases. If the slot 74 is tight (for example, the walls 76 are from about 0.03 inches to about 0.06 apart) and a bunched, forced creased bag has a ragged width, this coupled with the friction of the membrane 72 causes the crimped bag to be temporarily captured in each of the slots 74 as the waste is urged through the membrane 72.

The closer the slots 74 are to one another, the more ragged folded creases form and air will cause effective engagement by the narrow slots 74. An increase in this bunching occurs, resulting in a more effective temporary odor barrier. The random creases, along with air being trapped loosely therebetween gives the bunched up creases of the bag 16 sufficient width to become substantially trapped in the close slots 74. In fact, the slots 74 do not necessarily need to be formed by exactly parallel walls 76, rather, so long as along the length of the slot 74 at least one or a plurality of opposing walls of the slots 74 are close to each other to effect a temporary pinch.

While it is ideally more effective for the walls 76 of each slot 74 to be parallel to one another, the membrane 72 provides for the crease forming and consequent odor barrier formation functionality even when they are not parallel to one another, for example, when the walls 76 are interrupted so long as one or more points of one wall 76 remains sufficiently close to the opposing wall 76 of the slot 74. It should even suffice if one point along the wall 76 is sufficiently close to an opposing point on the opposing side of the wall 76. They can even be offset from each other.

An important aspect is the formation of the slot walls 76 to pinch and hold the bag once it enters the slot 74 formed by the walls 76. Other constructions of the slot walls 76 to provide for this pinch and hold effect are readily ascertainable by those skilled in the art to which this invention pertains in view of the disclosure herein and considered by the inventor to be part of the invention. Subsequent insertions allow the slots 74 to allow waste to push the walls 76 open and afterwards the walls 76 return to memory and once again repeat the pinches provided by the walls 76. This will continue without interruption until such time as the bag 16 is removed. Throughout this repeated procedure, the narrow slots 74 effectively significantly restrict any updraft of offensive odor from the contents of the bag 16 below. The central area where all of the slots 74 end should be reasonably the same size as that of the slot thickness (i.e., the distance between the opposed walls 76) because this selected dimension will in itself cause a pinch in the central area of the bag 16, as well.

In one embodiment, the channels formed by aligning slots 74 are less than the width of the bag 16 when flat (by appropriately selecting a bag). This dimensioning forces the bunching condition to continue to fill the slots 74 with bunched, crimped bag portions that effectively assist in sealing and preventing offensive odor from escaping the waste below the membrane 72.

Another important point relates to the closeness of the central area where the slots 74 meet. The closer the internal regions of the slots 74 are to one another, the better the seal of the remaining crimped bag that is not trapped by the slots 74. In a preferred embodiment, the central opening should be in a range from about 0.03 inches to about 0.10 inches which will effectively grab the remaining central area of the bag to complete the effective temporary seal throughout the process.

To assist in keeping the membrane 72 functioning effectively and with minimum drag, it is desirable that the bag 16 used with the waste disposal device 10 be long enough so that it rests comfortably on the base 20 of the waste disposal device 10 and remains so until such time as the bag 16 is full and ready for removal (exemplifying removal processes are described below). This minimizes drag and provides a seamless operation of odor containment. For example, a 21 inch high waste disposal device may use a longer bag such as one that is anywhere from about 32 inches to about 36 inches long. As the bag 16 fills up with waste, the bag 16 will remain full as still rest on the base of the waste disposal device 10 and the membrane 72 therefore will remain in its original state after each waste insertion. Reinforcement ribs 82 are advantageous especially when shorter bags are used if weight is an issue.

As used above, a membrane 72 is an example of a resilient component with narrow substantially reinforced slots 74 that when pressed (during waste insertion) causes the slots 74 to temporarily squeeze to thus have one side of the slot 74 engage the other side of the same slot 74. Furthermore, when a bag is placed on top of the membrane 72 and the waste, such as diapers, medical waste, left-over food, pet waste etc., is thus inserted to pass through the membrane 72 the following condition takes place: the width of the waste being inserted (diaper, a human hand inserting this waste, a crumpled milk carton, leftover take-out food etc) engages the bag 16 over the substantially parallel, close, substantially reinforced slots 74 which temporarily face each other and thus grab the bag (pinch it) leaving the bag substantially between each given slot 74 upon removing the hand.

Returning the membrane 72 to its previous, relaxed state is dependent on the weight of the waste below and the durometer of the membrane 72. Furthermore, the length of the slots 74, the reinforcement of the slots 74 and added reinforcement ribs 82 will contribute to the membrane 72 returning to its previous state and thus produce effective barrier containment as well as that of the prior art waste disposal device including costly complicated rotational components.

In a preferred embodiment, the membrane 72 is curved, the substantially planar walls 76 are parallel and close to one another, the slots 74 are reinforced with ribbing that when depressed, one wall 76 of a slot 74 engages (touches) the other wall 76 of the same slot 74, the slots 74 are not all the way across so the curved non-slotted area assists in urging the membrane 72 back to its previous state after each insertion of waste. Reinforcement ribs 82 and the membrane curvature coupled with the distance between slot ends further assists the membrane 72 to return to effectively pinch the bag effectively in each narrow, substantially parallel-walled slot 74.

With heavier waste below, even if there is still a little sag in the membrane 72, the majority of the bag is still substantially pinching tight the bag between slots 74. This condition is minimized by one or more factors:

1) a change of durometer (for example from softer Shore 65A to Shore 85A);

2) adding one or more reinforcement ribs 82 to compensate for the added weight; and 3) providing a reinforced slot 74 with raised ribbing around the narrow slot 74 to assist the temporary caving of one side of the slot 74 meeting the other side to form the necessary permanent pinch (until the bag is removed).

The action occurs upon either placing the bag through the first waste insertion. Subsequent waste insertions will keep the bag substantially trapped in the parallel slots 74 of the membrane 72 and thus form the desirable odor barrier as waste fills up the bag below the membrane 72.

In one embodiment, there is a more pronounced curvature of the membrane 72. The membrane 72 is curved from the curved wall of one slot 74 to the curved all of each adjacent slot 74. This curvature contributes to the inherent property of the membrane 72 to return from its open state during waste insertion to its previous, closed state prior to waste insertion. This curvature is one factor to consider when designing the membrane 72 because the greater the curvature, the greater the force is that urges the return of the membrane 72.

In waste disposal device 10, bag removal is facilitated by, once the bag 16 is full or it is otherwise desired to change the bag 16, pivoting the closure component 60 upward relative to the bag support 44 to release the clamping force of the closure component 60 against the bag support 44. Then, the end of the bag 16 is grasped, tied or knotted, and then inserted through the membrane 72 into the interior of the waste disposal device 10. Then, the bag support 44 is pivoted upward relative to the retainer 28 by, for example, the user inserting their finger into a recess 38 in the retainer 28 and lifting the bag support 44 upward, e.g., a tab 116 of the bag support 44, to thereby increase the size of the opening at the top of the waste disposal device 10. Finally, the bag 16 is grasped by the user's hand and pulled out of the interior of the waste container device 10 (see FIG. 5).

As an alternative, the waste disposal device 10 may be provided with a door in the wall construction 12. In this case, a person seeking to remove the bag 16 simply opens the door in the wall construction 12, inserts their hand into the interior of the waste disposal device 10 and removes the tied or knotted bag 16 therefrom.

A new, single use bag is then procured, placed into the interior of the waste disposal device 10. This placement may be either before the bag support 44 is pivoted downward to rest on the retainer 28 or after. In the former situation, the bag support 44 is pivoted downward and the user has to extend their hand through the membrane 72 to reach the upper end of the bag 16 and pull the bag 16 through the bag support 44 to drape the upper end over the inner wall. In the latter situation, the user pushes the bag 16 through the membrane 72 and then drapes the upper end of the bag 16 over the inner wall. In both situations, the upper end of the bag 16 has its open end draped over the inner wall and then the closure component 60 is pivoted against the inner wall to secure this new bag 16 in a position ready for use.

The user can also take this opportunity to adjust the height of the waste disposal device 10. For example, when a new bag is inserted, the waste disposal device 10 may be adjusted to its smallest height and then as waste is added, the height of the waste disposal device 10 is gradually increased to accommodate the waste, e.g., by pulling out the lowermost wall section 24, and after further waste insertions, pulling out the intermediate wall section 30. Once the waste disposal device 10 is at its largest height with both the lowermost and intermediate wall sections 24, 30 extended or expanded and the bag 16 is full of waste, then the bag of waste is removed and replaced with a new bag and the waste disposal device 10 collapsed.

Instead of the bag removal and insertion procedure described above involving the two pivotal movements to release the bag 16 from its clamping and then to increase the size of the opening, it is possible to construct the waste disposal device 10 with an access door in the wall construction 12, and then access the bag 16 with waste by opening the access door. An empty bag 16 may also be inserted through the access door and then its upper end passed upward through the membrane 72, then its upper end draped over the inner wall and then the closure component 60 closed to clamp the upper end of the bag 16 between the inner wall and the closure component 60.

Referring now to FIGS. 15-21, another embodiment of a waste disposal device in accordance with the invention is designated generally as 120 and includes the same bag retaining assembly 26 as described above and a telescoping wall construction 122 that is different than telescoping wall construction 12 described above. As used herein, and unless asserted otherwise, a telescoping wall construction means any wall construction that has different wall sections that, in a collapsed state, are housed inside an outermost one of the wall sections, and in an expanded state are arranged vertically one above or below another. In wall construction 12, the wall sections 18, 24, 30 are separate components that are not always connected to one another and slide relative to one another into and out of the expanded state (see FIG. 8). By contrast, in wall construction 122, at least some of the wall sections are always connected to one another, and it is possible that all of the wall sections are always connected to one another, both in the collapsed state and the expanded state. Notably, the wall sections fold into the collapsed state to form a zig-zag of material (see FIGS. 19 and 21). This type of folding configuration of wall sections is also being considered a telescoping wall construction.

Waste disposal device 120 includes five wall sections 124, 126, 128, 130, 132 in descending order with the uppermost wall section 124 preferably being a rigid wall section made of, for example, polypropylene. Wall section 124 may be made entirely of polypropylene or only at the upper edge region where it will engage with the bag handling assembly 26 because a rigid engagement point for the bag handling assembly 26 is desirable.

Wall sections 126, 128, 130, 132 may be made of silicone or injection-molded thermoplastic elastomeric material with weakened areas between each wall section to enable folding of the wall sections relative to one another, i.e., a flexible connection of the wall sections to one another. Wall sections 126, 128, 130, 132 may be made as a single piece of material, i.e., have a unitary structure. Each weakened area enables flexure of the adjacent wall sections relative to one another. Also, the wall sections taper inward such that the diameter of the upper edge of each wall section is greater than the diameter of the lower edge of each wall section. Although the wall sections 124, 126, 128, 130, 132 are shown having a circular cross-sectional shape, other shapes of wall sections are also possible.

In one embodiment, the wall sections 126, 128, 130, 132 are exclusively made from thermoplastic elastomers. It is however possible to make one or more of the wall sections 126, 128, 130, 132 over-molded from substantially rigid polypropylene. For example, part or all of the bottom wall section 132 that provides the base 134 of the wall construction 122 may be made of over-molded rigid polypropylene. Thus, an embodiment is possible wherein the bottom wall section 132 and the top wall section 124 are made of rigid material (polypropylene) while the intermediate wall sections 126, 128, 130 are made of a thermoplastic elastomer. It is also possible to make all of the wall sections 124, 126, 128, 130, 132 from rigid material and connect them together with flexible material to enable collapsing of the wall construction 122.

The specific thermoplastic elastomers that can be used for the wall sections 126, 128, 130, 132 would be readily ascertainable by or known to those skilled in the art to which this invention pertains in view of the disclosure herein. Also, instead of polypropylene, other comparable materials may be used, as would be readily ascertainable by or known to those skilled in the art to which this invention pertains in view of the disclosure herein. When the wall sections 124, 126, 128, 130, 132 are made of different materials, the connecting material or technique should provide for flexibility to enable the telescoping effect. Such connecting materials and techniques are readily ascertainable by or known to those skilled in the art to which this invention pertains.

Figure 15:
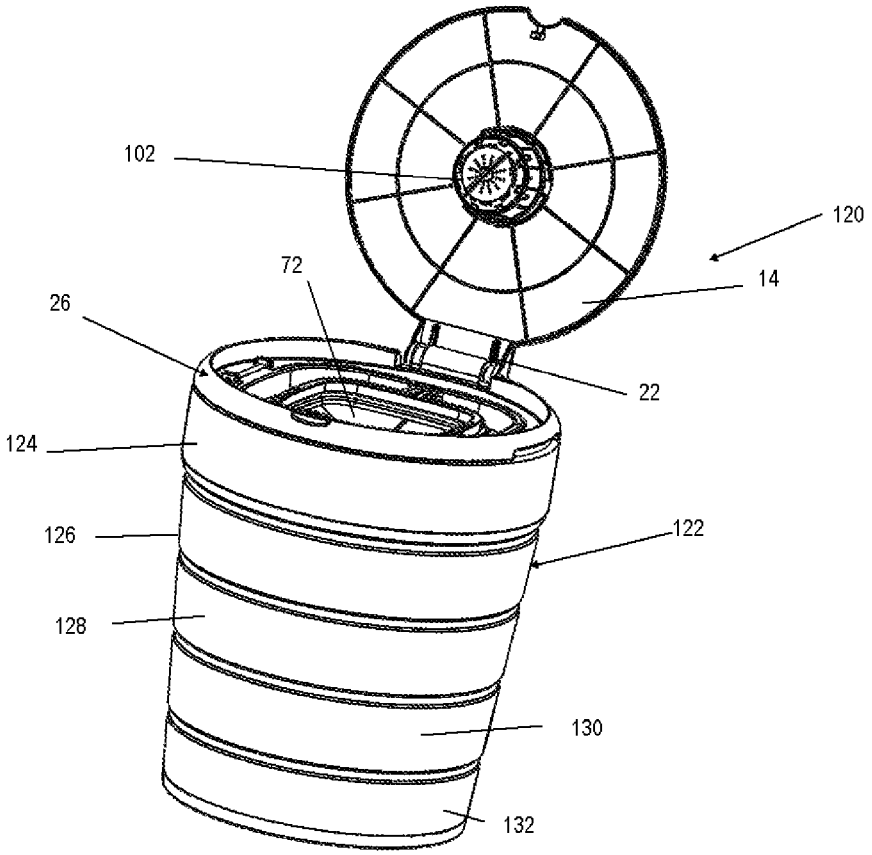
FIG. 15 is a perspective view of another embodiment of a waste disposal device in accordance with the invention having a largest height with the lid in an open state.
Figure 16:
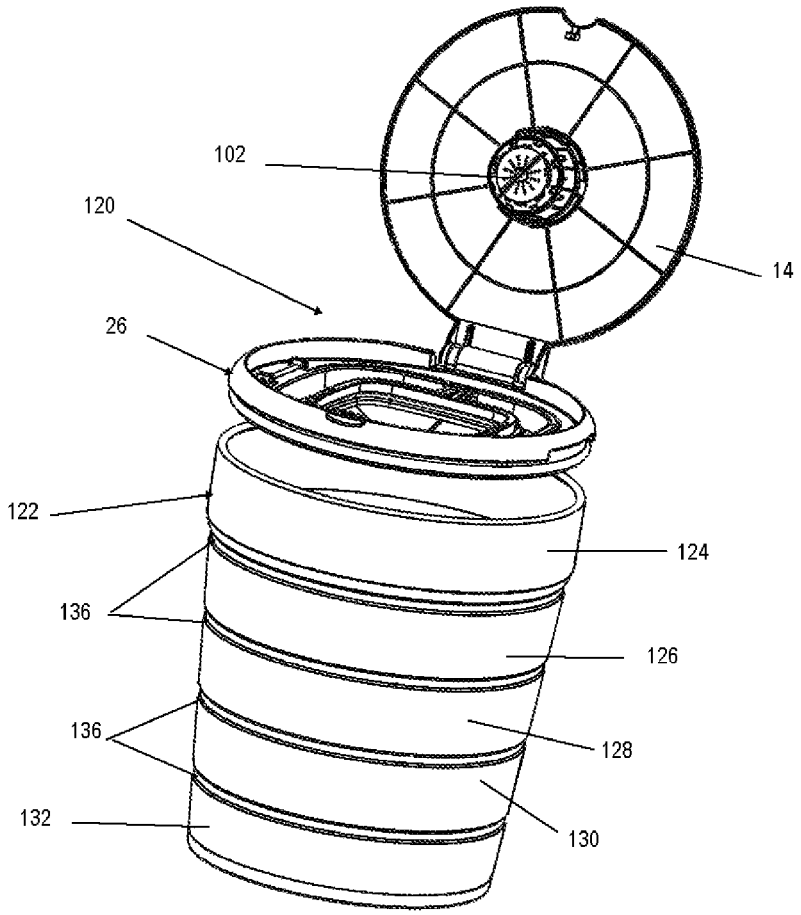
FIG. 16 is a perspective view of the waste disposal device shown in FIG. 15 showing a bag retaining assembly separated from a telescoping wall construction.

FIG. 15 shows the waste disposal device 120 having the largest height with the wall construction 122 expanded fully, e.g., to a height of about 10 inches. FIG. 16 shows that the waste disposal device 120 consists essentially of the two main parts, the bag handling assembly 26 and the wall construction 122 with the bag handling assembly 26 engaging with the upper wall section 124. The specific manner of engagement may be the same as any of those described above for engagement between the bag handling assembly 26 and the uppermost wall section 18.

Figure 17:
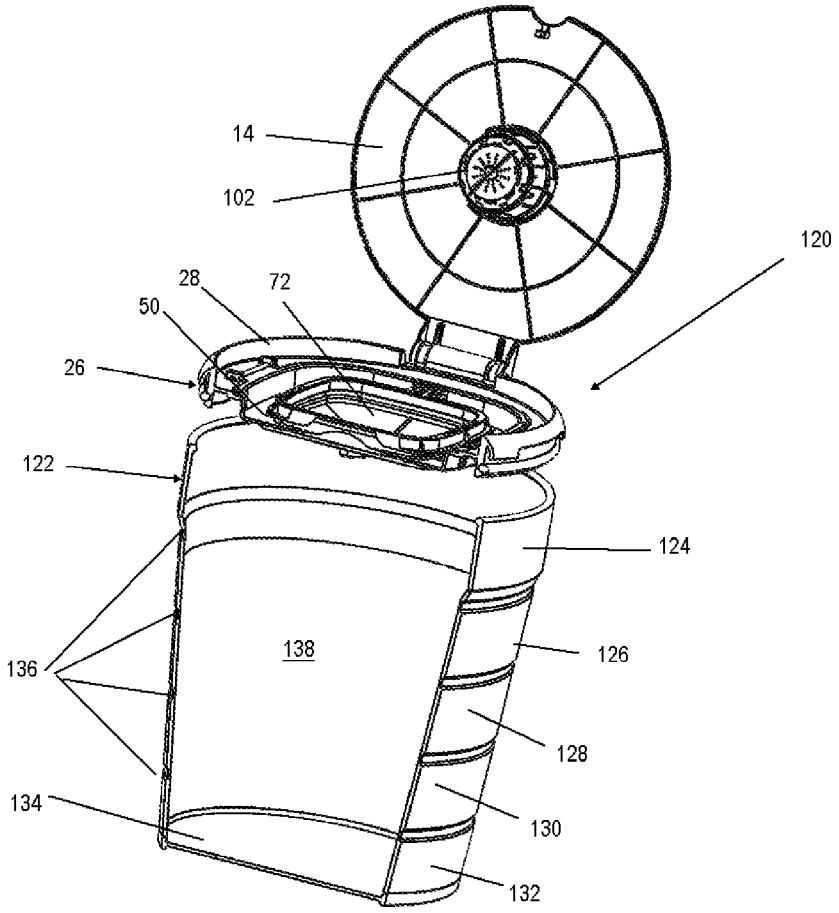
FIG. 17 is cross-sectional view through the waste disposal device shown in FIG. 16.

FIG. 17 shows the weakened areas 136 between the wall sections 124, 126, 128, 130, 132, as well as the interior 138 of the waste disposal device 120 into which a bag is operatively placed. These weakened areas enable the intermediate sections 126, 128, 130 to flex relative to the adjoining wall section.

Figure 18:
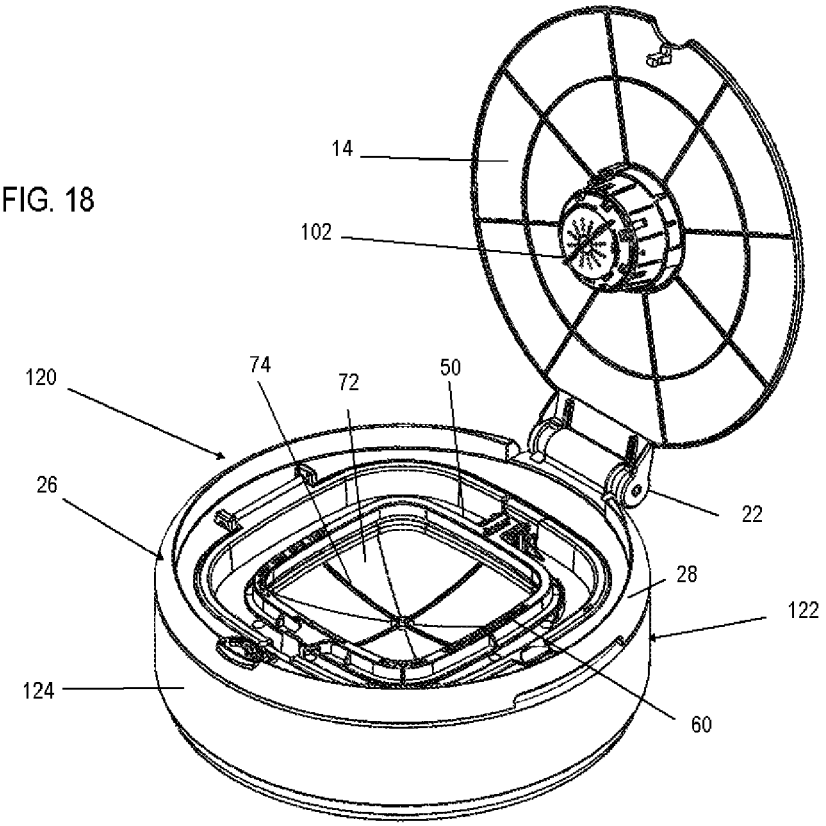
FIG. 18 is a perspective view of the waste disposal device shown in FIG. 15 having a smallest height with the lid in an open state.
Figure 19:
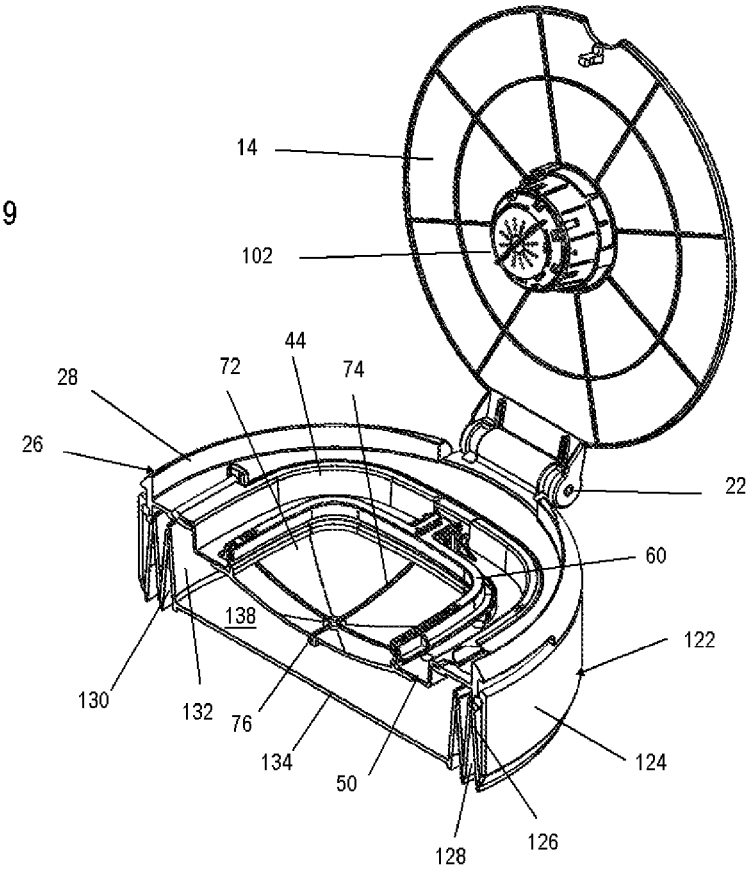
FIG. 19 is cross-sectional view through the waste disposal device in the state shown in FIG. 18.
Figure 20:
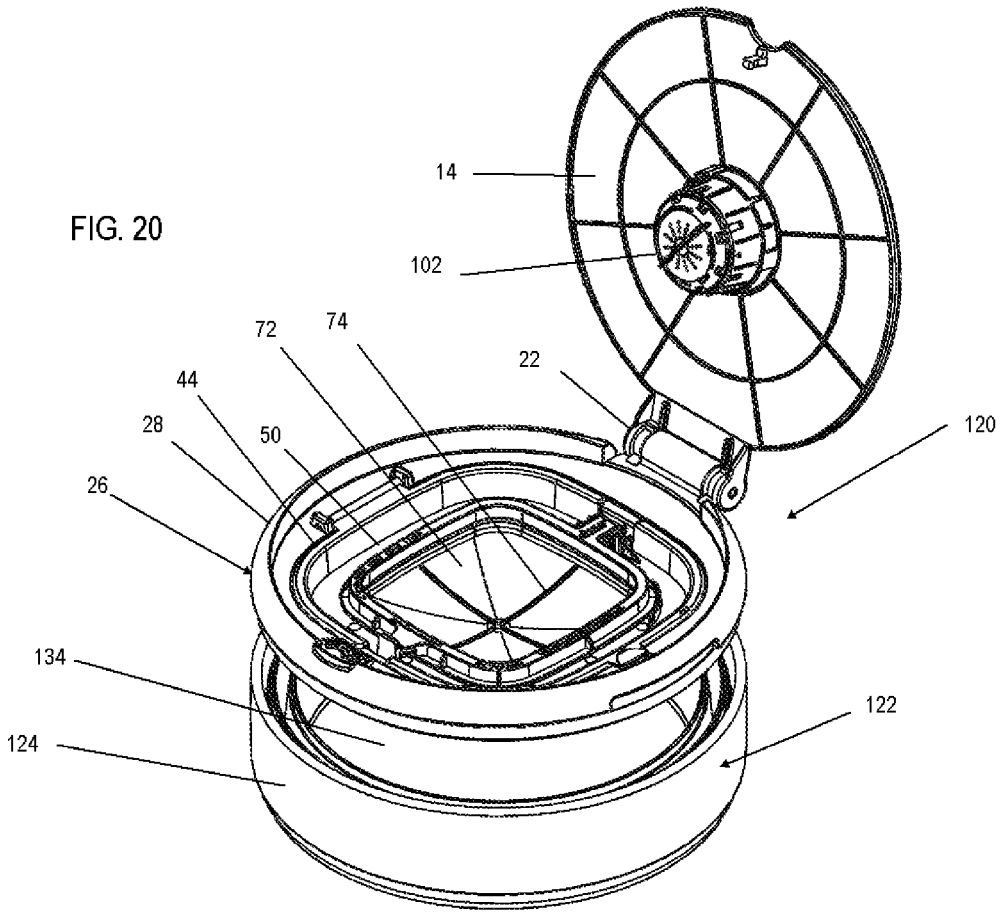
FIG. 20 is a perspective view of the waste disposal device in the state shown in FIG. 18 showing the bag retaining assembly separated from the telescoping wall construction.
Figure 21:
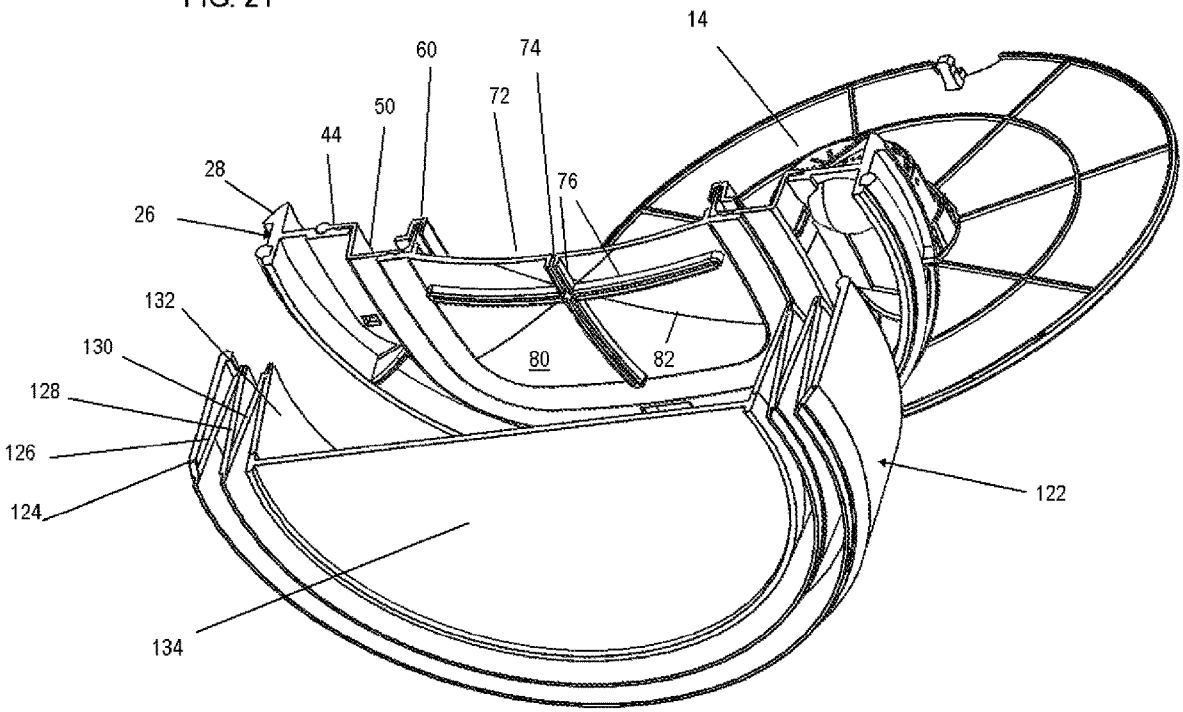
FIG. 21 is cross-sectional view through the waste disposal device in the state shown in FIG. 20 viewed from the bottom.

FIG. 18 shows waste disposal device 120 in the fully collapsed state, e.g., with a height of about 4-5 inches. Waste disposal device 120 is usable in this state, although the interior 138 is very small and cannot accommodate much waste. As shown in FIG. 19, wall sections 126, 128, 130, 132 are inward of the outermost wall section 124 in a zig-zag formation, see also FIG. 21. That is, wall section 126 has its upper edge region at the bottom adjoining the lower edge region of wall section 124, wall section 128 has its upper edge region at the top adjoining the lower edge region of wall section 126, wall section 130 has its upper edge region at the bottom adjoining the lower edge region of wall section 128, and wall section 132 has its upper edge region at the top adjoining the lower edge region of wall section 130.

Wall construction 122 is moved between the expanded state shown in FIGS. 15-17 and the collapsed state shown in FIGS. 18-21 by pulling the base 134 apart from the uppermost wall section 124, e.g., using apertures 66 (not shown). Collapsing of the wall construction 122 is achieved by, for example, placing the waste disposal device 120 on a flat surface and pushing downward against the flat surface.

Wall construction 122 does not have to be fully expanded. Rather, it is possible to expand the wall construction 122 so that only sections 132, 130 and 124 are visible, with wall sections 126 and 128 being situated inside of and surrounded by wall section 124. If more than five wall sections are provided in wall construction 122, then there would be additional intermediate states of use of the waste disposal device 120.

An important feature of the embodiments of the waste disposal devices disclosed herein is that they do not include costly complicated rotational components that serve to rotate the membrane while waste is entrained thereby. Lack of structure to enable rotation of the membrane enables considerably more simplified structure to retain the membrane and support the membrane on the container wall.

Another important advantage of waste disposal devices with the membrane disclosed above is that it becomes possible to remove waste with minimal exposure to direct contact with odiferous and potential hazardous waste contents, there being sealed off below the membrane. The removal process entails tying a knot in a bag passing through the membrane. This bag, or more specifically the open edge of the bag, may be retained by structure on the membrane retainer or support structure such as disclosed in the patents and application mentioned above, or secured between the membrane retainer or support structure and a container wall. To enable tying of the knot, the open edge of the bag is first released from its retention, if necessary. It is possible that the bag is a drawstring bag which, instead of tying a knot, simply requires pulling on the drawing to close the bag and then tying the drawstring to itself, i.e., knotting the drawstring.

Regardless of the type of bag, the open edge of the bag is closed at a location above the membrane. The bag is then removed from the container without concern of odor from the bag releasing from the bag. For example, it is possible to insert the now-closed end of the bag through the membrane into the container, then lift the bag retaining structure upward to access the interior of the container and then lift out the waste-containing bag.

This provides a substantial improvement to prior waste disposal devices which involve direct exposure to the contents, for example, in those conventional waste pails utilizing inner liners, and to those diaper pails (e.g., sold by Munchkin and sold under the tradename Diaper Genie™) whereby the person removing the waste-containing bag has their face in front of the open bag each time then need to cut the tubing and tie the filled bag for subsequent removal. At this time, the tubing is further tied or knotted to begin a new bag. This exposure can, depending on the person's level of speed, last for a few minutes which unfortunately results in somewhat annoying exposure to, for example, odors from soiled fecal and urine-soaked baby diapers, as well as to possible contagions from the waste.

In the invention, by safely separating the waste below the membrane 72 from the beginning of the waste disposal process (since the bag placed into the container through the membrane 72 is initially sealed, and safely sealing it (tying a knot above the membrane 72) makes this a non-obvious distinct advantage.

This invention (notably, the bag handling assembly 26 with membrane 72) can be integrated into a waste disposal device in its entirety, or can be sold or offered as a retrofit to the myriad of existing waste disposal devices currently in use in homes, hospitals, nursing homes, bio-labs, offices and the like. This conversion can offer a level of safety where smell, bacteria and fungus pose a serious or annoying issue.

Durometer of the membrane 72 plays a critical component insofar as, depending on the contents and weight below the membrane 72, contributes to improving the function of the membrane 72 that provides an effective barrier. Appropriate selection of the durometer of the membrane 72 can be achieved by testing the same membrane 72 structure made from materials with different durometers, e.g., from Shore 65A to Shore 85A, and identifying which perform best. The best membrane durometer may be dependent on other factors, e.g., the size of the membrane 72, the number and size of the slots 74, the height of the walls below the lower surface 80 of the membrane 72, the length of the slots 74, the presence, number and construction of the reinforcement ribs 82, the expected weight of the waste, the expected thickness of the bag 16 to be used with the membrane 72, and other factors that would be obvious to those skilled in the art to which this invention pertains.

As used above, a membrane is an example of a resilient component that includes slots or slits to enable material passage therethrough. Other units or components that provide a similar functionality and may be referred to by a name other than a membrane are also considered to be encompassed by reciting a membrane in this specification.

There are significant advantages of the waste disposal device 10. Among others, waste disposal device 10 provides for improved odor control relating to odors of waste emanating from or generated by pets, babies, adults, hospitals, nursing homes, day care centers, etc. In addition, the waste disposal device 10 can be collapsed if in an expanded state to provide it with a conveniently small, compact form for the purposes of traveling or reduction of size during storage or when being sold at retail outlets where space is a premium. Once at the site of use, e.g., in a home, office or laboratory, the user simply opens the waste disposal device 10 telescopically for adjustable functionality, i.e., expands it to the desired height. The ability to have a compact form, and then be convertible into a usable, expanded form, thereby reduces space for storage and display and shipping charges.

The bag handling assembly 26 can have any of the characteristics disclosed for a bag handling assembly in U.S. patent application Ser. No. 16/207,338 filed Dec. 3, 2018, incorporated by reference herein. Some of these are advantageous as discussed therein and above.

Another advantage is that the waste disposal device 10 is able to be stored in a form ready to accept waste. This is advantageous because by having the waste disposal device 10 ready for quick use and waste disposal during traveling, the user only has to lift the lid 14 and insert a diaper or other waste, knowing that the waste disposal device 10 will control odors. The person does not have to worry about a soiled diaper stinking up the air, but can insert the soiled diaper into the waste disposal device 10 and be relieved of any concern of embarrassing offensive odor emanating from the soiled diaper, or other waste. Indeed, with the bag handling assembly 26 in place in the collapsed state of the wall construction 12, with a bag 16 already in place, the user simply pulls the lid 14 open (optionally extending the wall construction 12 if additional room is needed for the waste), and is immediately ready to insert a soiled diaper, or adult non-woven disposable waste containing undergarment into the waste disposal device 10 through the membrane 72 which forms the tightly slotted odor barrier. Closure of the membrane 72 after waste insertion will cause a plurality of tight creases through the membrane slots 74 to contain (hold down) the offensive odor and potential spread of germs, etc.

Figure 2:
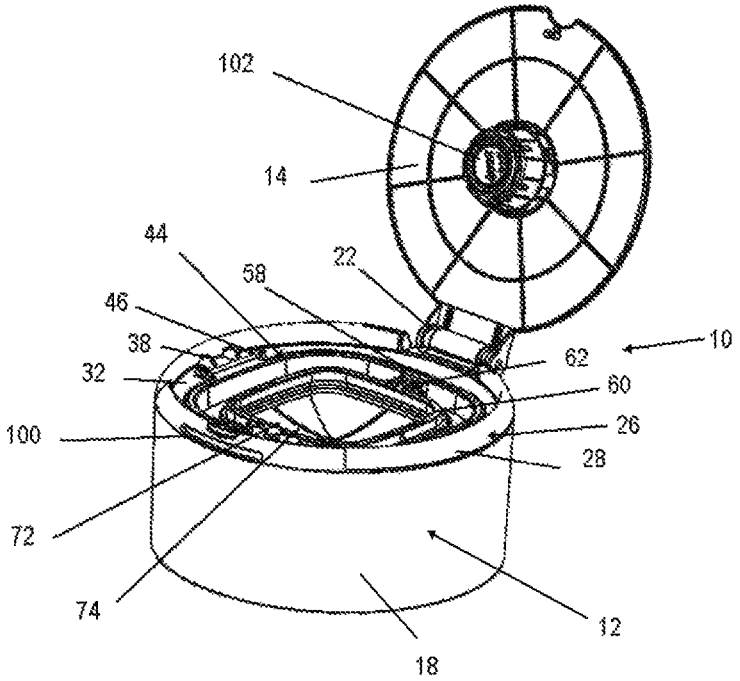
FIG. 2 is a top perspective view of the waste disposal device of FIG. 1 shown in a state in which the lid is open.
Figure 3:
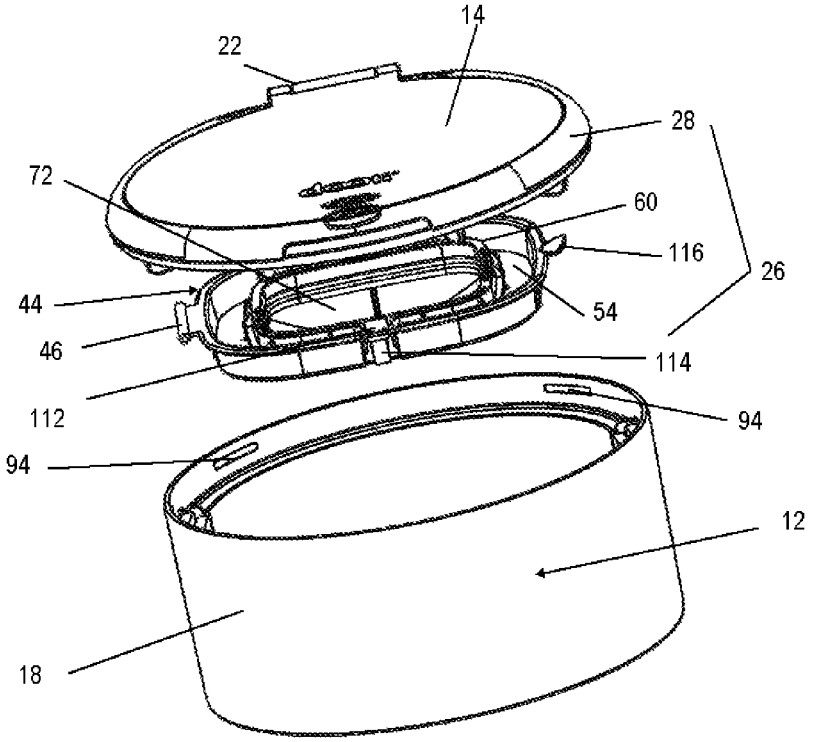
FIG. 3 is an exploded front perspective view of the waste disposal device of FIG. 1 shown in a state in which the lid is closed.
Figure 4:
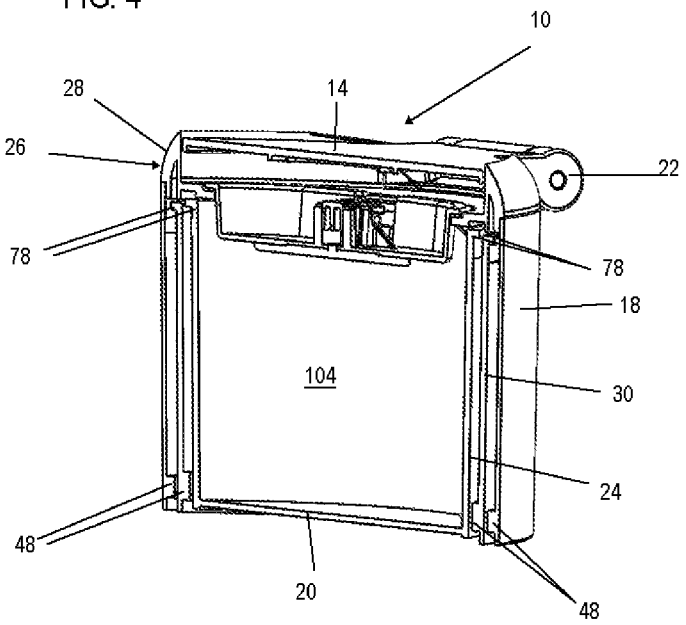
FIG. 4 is a cross-sectional view of the waste disposal device of FIG. 1 shown in a state in which the lid is closed.

An optional waste treatment component 102 can be seen in, for example, FIGS. 2 and 5, and is attached to the underside of the lid 14. Waste treatment component 102 holds odor reducing compounds and/or air freshening compounds to aid in odor control.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention. Indeed, the membranes disclosed above may be used in any of the waste containers or waste disposal devices disclosed in the patents and application incorporated by reference herein, e.g., those identified above, to the extent the waste disposal devices include a membrane that can be replaced by the membranes disclosed herein.

The invention claimed is:

1. A container, comprising:

a telescoping wall construction defining an interior space receivable of a bag, said wall construction having wall sections positionable in a plurality of different positions to provide said wall construction with a plurality of different heights; and a bag handling assembly coupled to an upper end region of said wall construction, said bag handling assembly comprising:

a bag support defining an opening and including a membrane having at least one slot through which the bag passes when present;

a retainer extending inward from said wall construction at an upper end region of said wall construction, said retainer defining an opening, said bag support being pivotally coupled to said retainer; and a closure component pivotally coupled to said bag support independent of the pivotal coupling of said bag support to said retainer, said closure component defining an opening at least partly aligning with the opening defined by said retainer, said bag support and said closure component including cooperating clamping structure that clamps the bag when present between said bag support and said closure component while said closure component is pivoted against said bag support.

2. The container of claim 1, wherein said wall sections include a lowermost wall section defining a base of said wall construction, an uppermost wall section defining the upper end region of said wall construction to which said bag handling assembly is coupled, and an intermediate wall section between said lowermost and uppermost wall sections.

3. The container of claim 2, wherein said wall sections have the same cross-sectional shape, and when in a collapsed state, said lowermost wall section is at least partly inward of said intermediate wall section and said intermediate wall section is at least partly inward of said uppermost wall section.

4. The container of claim 2, wherein said base includes expansion initiation means for initiating expansion of said wall construction.

5. The container of claim 4, wherein said expansion initiation means comprises at least one aperture in said base and at least one well aligning with said at least one aperture to enable manual grasping of said base via said at least one well.

6. The container of claim 1, further comprising connecting mechanisms for connecting adjacent pairs of said wall sections together, each of said connecting mechanisms comprising a ridge on an inner surface of an uppermost one of said adjacent pair of wall sections and an inwardly projecting lower flange below said ridge on the uppermost one of said adjacent pair of wall sections that form a channel therebetween and an upper flange on a lowermost one of said adjacent pair of wall sections that fits into said channel to thereby provide for engagement between said adjacent pair of wall sections when said upper flange is in said channel.

7. The container of claim 6, wherein said lower flange extends from a lower edge of the uppermost one of said adjacent pair of wall sections and said upper flange extends from an upper edge of the lowermost one of said adjacent pair of wall sections, said upper and lower flanges extending substantially equal distances along a peripheral edge of said adjacent pair of wall sections.

8. The container of claim 6, further comprising a release mechanism associated with each of said connecting mechanisms, said release mechanism being situated on the lowermost one of said adjacent pair of wall sections and comprising a press tab deflectable inward to release said upper flange from said channel and enable insertion of the lowermost one of said adjacent pair of wall sections into the uppermost one of said adjacent pair of wall sections.

9. The container of claim 6, further comprising first support flanges on the uppermost one of said adjacent pair of wall sections and second support flanges on the lowermost one of said adjacent pair of wall sections that engage with said first support flanges.

10. The container of claim 1, wherein said bag handling assembly further comprises springs and said wall construction includes indentations on an inner surface adapted to receive said springs such that when said springs are received in said indentations, said bag handling assembly is secured to said wall construction.

11. The container of claim 1, wherein each of said at least one slot is defined by a pair of opposed walls spaced apart a distance to enable a bag, when inserted through said at least one slot, to be pinched by said opposed walls.

12. The container of claim 11, wherein said membrane further comprises reinforcement ribs on a surface that project beyond said surface and extend from a central region of said membrane linearly toward a circumferential edge of said membrane, said reinforcement ribs being situated in an area of said membrane between and spaced apart from said opposed walls, said at least one slot comprising a plurality of slots and each of said reinforcement ribs being situated between a respective adjacent pair of said slots.

13. The container of claim 12, wherein each of said reinforcement ribs is spaced apart equally from the adjacent pair of said slots.

14. The container of claim 1, wherein said membrane further comprises reinforcement ribs on a lower surface that project beyond said lower surface and extend from a central region of said membrane toward a circumferential edge of said membrane, said at least one slot comprising a plurality of slots and said reinforcement ribs are each situated between an adjacent pair of said slots.

15. The container of claim 1, wherein said at least one slot comprises a plurality of slots and a durometer of said membrane is selected to provide a return effect after fingers of said membrane defined between adjacent ones of said slots are pressed downward.

16. The container of claim 1, further comprising first attachment means for pivotally attaching said bag support to said retainer, said first attachment means comprising a hinge component on said retainer and a cooperating hinge component on said bag support on a first side of the opening defined by said retainer.

17. The container of claim 1, further comprising:

first attachment means for pivotally attaching said bag support to said retainer, said first attachment means comprising a hinge component on said retainer and a cooperating hinge component on said bag support on a first side of the opening defined by said retainer; and second attachment means for pivotally attaching said closure component to said bag support, said second attachment means comprising an additional hinge component on said bag support and a cooperating hinge component on said closure component on a second side of the opening defined by said retainer such that said first and second attachment means are on different sides of the opening defined by said retainer.

18. The container of claim 1, wherein said wall construction comprises a plurality of wall sections flexibly connected to one another and that bend about connection points into a folded state while connected to one another and expanded into an expanded state while connected to one another.

19. The container of claim 18, wherein said plurality of wall sections include an uppermost wall section made of a rigid material, a lowermost wall section made at least partly of a rigid material and at least one intervening wall section made of thermoplastic elastomer material.

20. The container of claim 1, wherein each of said at least one slot is defined by a pair of opposed, parallel walls and a connecting wall at each end of said slot connecting said opposed walls together, said opposed walls of each of said at least one slot being spaced apart a common distance along a length of said slot between a central region of said membrane and said connecting wall to enable a bag, when inserted through said at least one slot, to be pinched by said opposed walls.

* * * * *